US010982369B2

(12) United States Patent
Kim et al.

(10) Patent No.: US 10,982,369 B2
(45) Date of Patent: Apr. 20, 2021

(54) WASHING MACHINE AND CONTROL METHOD THEREFOR

(71) Applicant: Samsung Electronics Co., Ltd, Suwon-si (KR)

(72) Inventors: Dong Young Kim, Seoul (KR); Adam Wishney, Singapore (SG); Doo Young Rou, Suwon-si (KR); In Ju Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 376 days.

(21) Appl. No.: 15/752,185

(22) PCT Filed: Jul. 29, 2016

(86) PCT No.: PCT/KR2016/008327
§ 371 (c)(1),
(2) Date: Feb. 12, 2018

(87) PCT Pub. No.: WO2017/026711
PCT Pub. Date: Feb. 16, 2017

(65) Prior Publication Data

US 2018/0237971 A1 Aug. 23, 2018

(30) Foreign Application Priority Data

Aug. 11, 2015 (KR) ..... 10-2015-0112903

(51) Int. Cl.
*D06F 33/00* (2020.01)
*D06F 34/18* (2020.01)
(Continued)

(52) U.S. Cl.
CPC ..... *D06F 33/00* (2013.01); *D06F 34/18* (2020.02); *D06F 37/10* (2013.01); *D06F 37/42* (2013.01);
(Continued)

(58) Field of Classification Search
CPC ..... D06F 33/00; D06F 34/18; D06F 37/10; D06F 37/28; D06F 37/42; D06F 39/14;
(Continued)

(56) References Cited

U.S. PATENT DOCUMENTS 7,418,754 B2 9/2008 Kim et al.
7,543,346 B2 6/2009 Roh et al.
(Continued)

FOREIGN PATENT DOCUMENTS

CL 2017003049 A1 3/2018
CL 2017003050 A1 3/2018
(Continued)

OTHER PUBLICATIONS

Notice of Preliminary Rejection regarding Korean Patent Application No. 10-2015-0112903, dated Aug. 29, 2017, 16 pages.
(Continued)

*Primary Examiner* — Levon J Shahinian

(57) ABSTRACT

Proposed are a washing machine and a control method therefor, which may allow a user to safely and additionally put laundry in during the operation of the washing machine including an auxiliary door. The washing machine includes an auxiliary door through which laundry is additionally put in, indicates whether additionally putting-in of laundry during the operation of the washing machine is allowed, and enables a user to determine the same, in order to provide an algorithm for safely operating the auxiliary door, and checks a rotation of a drum, a temperature of the inside, and a level of water when it is desired to additionally put laundry in, so as to enable the user to safely put the laundry in. Also, when the user additionally puts laundry in while the washing machine performs a cycle, the washing machine changes a cycle profile for each cycle, and corrects a cycle profile
(Continued)

according to an additional put-in point, thereby raising reliability of the user for the washing machine.

15 Claims, 15 Drawing Sheets

(51) Int. Cl.
*D06F 37/10* (2006.01)
*D06F 37/28* (2006.01)
*D06F 37/42* (2006.01)
*D06F 39/14* (2006.01)

(52) U.S. Cl.
CPC ..... *D06F 37/28* (2013.01); *D06F 39/14* (2013.01); *D06F 2202/04* (2013.01); *D06F 2204/10* (2013.01); *D06F 2212/06* (2013.01); *D06F 2216/00* (2013.01); *D06F 2224/00* (2013.01)

(58) Field of Classification Search
CPC ..... D06F 2202/04; D06F 2204/10; D06F 2212/06; D06F 2216/00; D06F 2224/00
USPC ..... 8/158, 159; 68/12.21, 12.26, 75, 139
See application file for complete search history.

(56) References Cited

U.S. PATENT DOCUMENTS

| | | | |
|---|---|---|---|
| 2013/0055770 | A1 | 3/2013 | Kim et al. |
| 2018/0135231 | A1 | 5/2018 | Park et al. |
| 2018/0171533 | A1 | 6/2018 | Lee et al. |
| 2018/0340286 | A1 | 11/2018 | Kim et al. |

FOREIGN PATENT DOCUMENTS

| | | | |
|---|---|---|---|
| CL | 2017003048 | A1 | 4/2018 |
| CN | 1782181 | A | 6/2006 |
| CN | 102965882 | A | 3/2013 |
| EP | 0384148 | A1 | 8/1990 |
| EP | 2415920 | A1 | 2/2012 |
| JP | H0790077 | B2 | 10/1995 |
| JP | 2002336593 | A | 11/2002 |
| JP | 2003-245490 | A | 9/2003 |
| JP | 2004267334 | A | 9/2004 |
| KR | 10-2004-0015480 | A | 2/2004 |
| KR | 10-206-0004101 | A | 1/2006 |
| KR | 10-0776257 | B1 | 11/2007 |
| KR | 10-0929229 | B1 | 12/2009 |
| KR | 10-2010-0081232 | A | 7/2010 |
| KR | 10-1215450 | B1 | 12/2012 |
| KR | 10-1481518 | B1 | 1/2015 |

OTHER PUBLICATIONS

Notice of Final Rejection regarding Korean Patent Application No. 10-2015-0112903, dated Feb. 26, 2018, 6 pages.
Chilean Industrial Property Law, "Grounds for Examiner's Report," Application No. CL201703051, dated Apr. 22, 2019, 16 pages.
International Search Report dated Oct. 27, 2016 in connection with International Patent Application No. PCT/KR2016/008327.
Written Opinion of the International Searching Authority dated Oct. 27, 2016 in connection with International Patent Application No. PCT/KR2016/008327.
Instituto Nacional De Propiedad Industrial (INAPI) Chile, Office Action for Application No. CL201703051 dated Dec. 13, 2018, 25 pages.
Korea Intellectual Property Office, Office Action for Application No. KR 10-2018-0048376, dated Jan. 29, 2019, 12 pages.
Office Action dated Nov. 28, 2019 in connection with Chinese Patent Application No. 201680040331.5, 20 pages.
Notice of acceptance for patent application dated Sep. 24, 2018 in connection with Australian Patent Application No. 2016306814, 3 pages.
Supplementary European Search Report dated Oct. 16, 2018 in connection with European Patent Application No. 16 83 5351, 10 pages.
Korean Intellectual Property Office, "Notice of Allowance," Application No. KR 10-2018-0048376, dated Aug. 18, 2019, 3 pages.
Supplementary Partial European Search Report dated Jul. 4, 2018 in connection with European Patent Application No. 16 83 5351.
Office Action dated Jul. 5, 2018 in connection with Korean Patent Application No. 10-2018-0048376.
Office Action dated May 24, 2018 in connection with Australian Patent Application No. 2016306814.
Office Action dated May 21, 2018 in connection with Korean Patent Application No. 10-2015-0112903.
The Second Office Action in connection with Chinese Application No. 201680040331.5 dated Aug. 28, 2020, 14 pages.
Rejection Decision dated Jan. 18, 2021 in connection with Chinese Patent Application No. 201680040331.5, 13 pages.
Rejection Decision dated Jan. 18, 2021 in connection with Chinese Patent Application No. 201680040331.5, 8 pages.

WASHING MACHINE AND CONTROL METHOD THEREFOR

CROSS-REFERENCE TO RELATED APPLICATIONS

The present application is a 371 national stage entry of International Patent Application No. PCT/KR2016/008327 filed Jul. 29, 2016 which claims priority to Korean Patent Application No. 10-2015-0112903 filed Aug. 11, 2015, each of which are incorporated herein by reference into the present disclosure as if fully set forth herein.

TECHNICAL FIELD

The present disclosure relates to a washing machine including an auxiliary door and a method of controlling the same, and more particularly, to a washing machine which allows laundry to be additionally loaded during operation of the washing machine, and a method of controlling the same.

BACKGROUND

In general, washing machines, for example, drum washing machines, are apparatuses which include a tub for storing water (washing water or rinsing water), a drum rotatably installed inside the tub and configured to accommodate laundry and a motor configured to generate a driving force for rotating the drum and in which, when the drum is rotated, the laundry inside the drum ascends or descends along inner walls of the drum so that the contaminated laundry can be washed.

A laundry port through which the laundry can be put into or taken out of the inside of the drum is formed in the washing machine, and a door is disposed to open and close the laundry port. Thus, a user opens the door to take or put the laundry out of or into the drum.

When operation of the washing machine is started, the door is kept in a locked state. Thus, when the user wants to additionally load laundry, the user needs to open the door. In order to open the door during the operation of the washing machine, it is necessary to wait until a wash cycle is finished, or supplied water is drained. In this way, it is not easy to additionally load laundry during the operation of the washing machine.

SUMMARY

The present disclosure is directed to providing a washing machine which includes an auxiliary door through which laundry can be additionally put into the washing machine and the auxiliary door can be operated safely, and a method of controlling the same.

The present disclosure is also directed to providing a washing machine in which, whether the washing machine allows laundry to be additionally loaded during the operation of the washing machine is displayed, and when the laundry is to be additionally loaded, the rotation and internal temperature of a drum and water level are checked so that the washing machine allows the laundry to be safely put thereinto, and a method of controlling the same.

The present disclosure is also directed to providing a washing machine in which, when the laundry is additionally loaded while a cycle of the washing machine is performed, a cycle profile is changed for each cycle, and the cycle profile is compensated according to a time when the laundry is additionally loaded, and a method of controlling the same.

One aspect of the present disclosure provides a washing machine including a main body configured to form an exterior of the washing machine and has a laundry port therein; a tub installed inside the main body and configured to accommodate water; a drum rotatably installed inside the tub and configured to accommodate laundry; a detector configured to detect a temperature inside the tub; a main door installed in the main body to open and close the laundry port; an auxiliary door installed in the main door and configured to be openable and closable separately from the main door; an inputter through which an operational signal for opening and closing of the auxiliary door is input; and a controller configured to control locking of the auxiliary door based on the temperature detected by the detector in response to the operational signal.

The detector may detect a temperature inside the drum when the operational signal is input during operation of the washing machine, and the controller unlocks the auxiliary door when the detected temperature is lower than a set temperature.

The detector may further detect whether the drum is being rotated, and the controller may control the locking of the auxiliary door based on whether the drum is being rotated.

The controller may further inform a user of an openable or closable state of the auxiliary door according to the detected temperature inside the drum and whether the drum is being rotated.

The detector may further detect a level of water stored in the tub, and the controller may control locking of the auxiliary door based on the detected level.

The auxiliary door may maintain a locked state during operation of the washing machine, and the drum may stop rotating when the locked state of the auxiliary door is released.

The controller may control locking of the main door based on the temperature detected by the detector in response to the operational signal.

The controller may compare the detected temperature with a set temperature, and unlocks the main door according to a comparison result.

The detector may further detect whether the drum is being rotated, and the controller may control locking of the main door based on whether the drum is being rotated.

The controller may inform a user of an openable or closable state of the main door according to the detected temperature inside the drum and whether the drum is being rotated.

Another aspect of the present disclosure provides a method of controlling a washing machine including a main body having a laundry port therein, a tub installed inside the main body and configured to accommodate water, a drum rotatably installed inside the tube, a main door installed in the main body to open and close the laundry port, and an auxiliary door installed in the main door and configured to be openable and closable separately from the main door, the method including: determining whether an operational signal is input for opening of the auxiliary door while a cycle of the washing machine proceeds; and controlling a profile for each cycle of the washing machine when the operational signal is input.

The method according to another aspect of the present disclosure may further include counting down a washing time at an input time of the operating signal when the operating signal is input during the wash cycle; and extending a time of performing the wash cycle when the counted down washing time is compared with a set time and the washing time exceeds the set time.

The method according to another aspect of the present disclosure may further include determining the number of times of rinsing carried out at an input time of the operating signal when the operational signal is input during the rinse cycle; and controlling the number of times of rinsing of the rinse cycle when the number of times of rinsing carried out is not one.

The method according to another aspect of the present disclosure may further include informing a user of an unopenable state of the auxiliary door according to a spin dry RPM at an input time of the operating signal when the operational signal is input during the spin dry cycle.

In a proposed washing machine and a method of controlling the same, an auxiliary door through which laundry can be additionally put into the washing machine is provided, and an algorithm for safely operating the auxiliary door is provided. To this end, whether laundry can be additionally loaded during the operation of the washing machine is displayed for a user to check, and when the laundry is to be additionally loaded, the rotation and internal temperature of a drum and water level are checked so that the laundry can be safely put into the washing machine.

Further, when the laundry is additionally loaded while a cycle of the washing machine is performed, a cycle profile is changed for each cycle, and the cycle profile is compensated according to a time when the laundry is additionally loaded so that a user's trust in the washing machine can be enhanced.

DETAILED DESCRIPTION

Hereinafter, one embodiment of the present disclosure will be described in detail with reference to the accompanying drawings.

Figure 1:
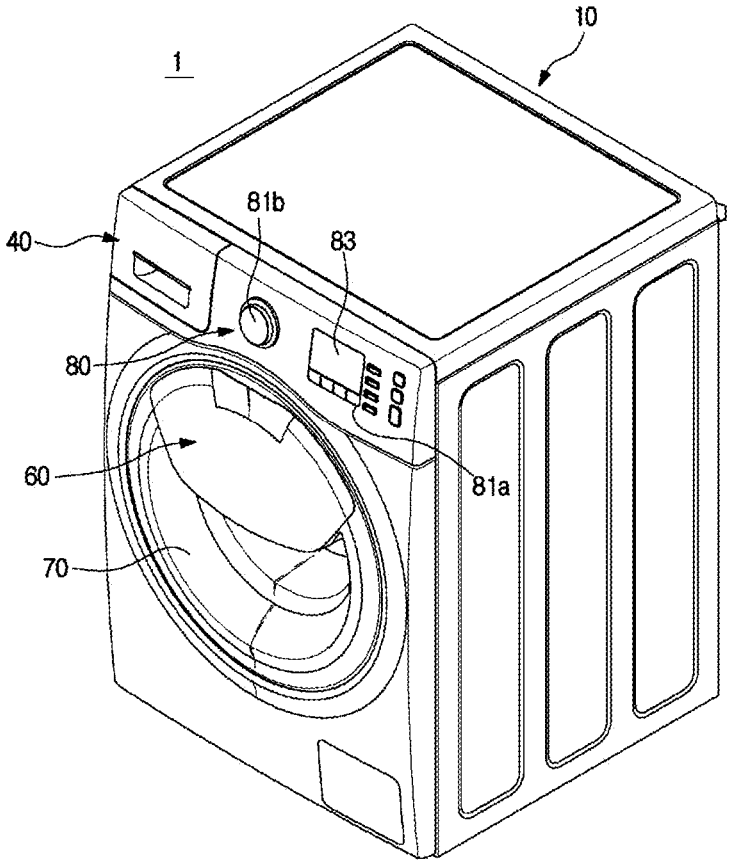
FIG. 1 is a perspective view of an exterior of a washing machine according to one embodiment of the present disclosure.
Figure 2:
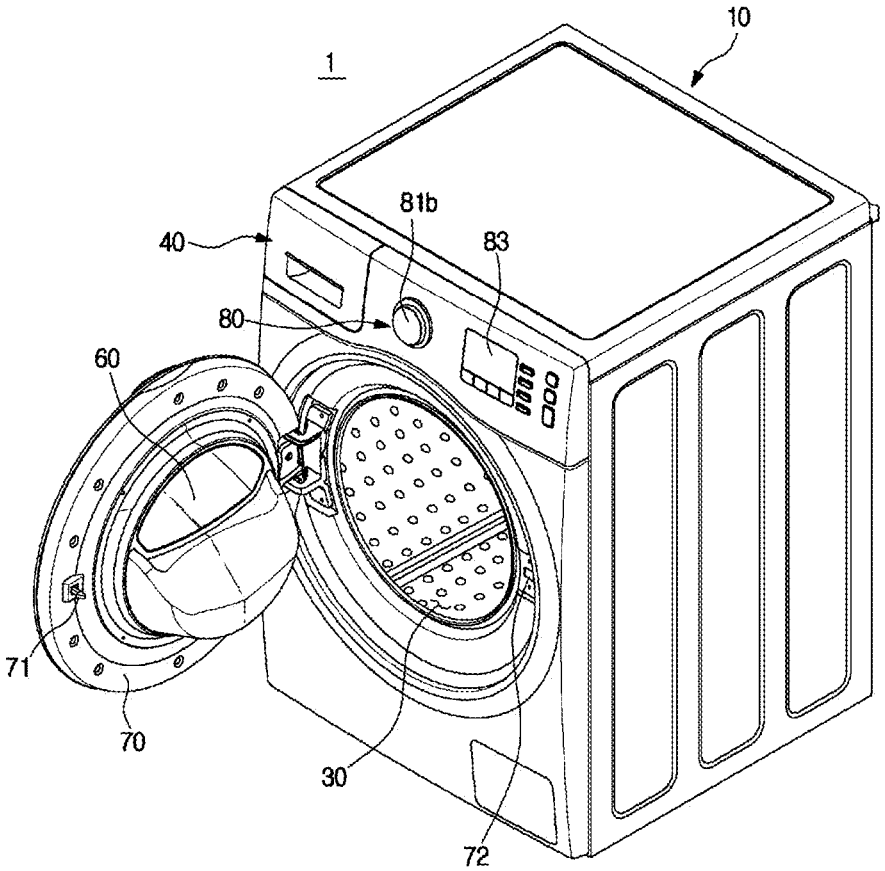
FIG. 2 is a perspective view of a state in which a main door of the washing machine according to one embodiment of the present disclosure is opened.
Figure 3:
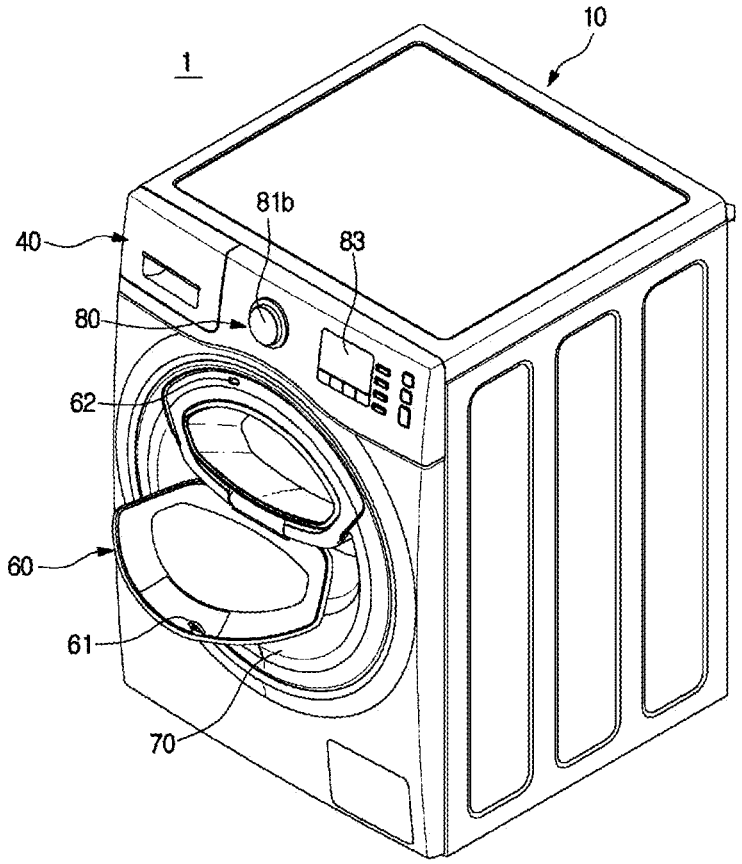
FIG. 3 is a perspective view of a state in which an auxiliary door of the washing machine according to one embodiment of the present disclosure is opened.
Figure 4:
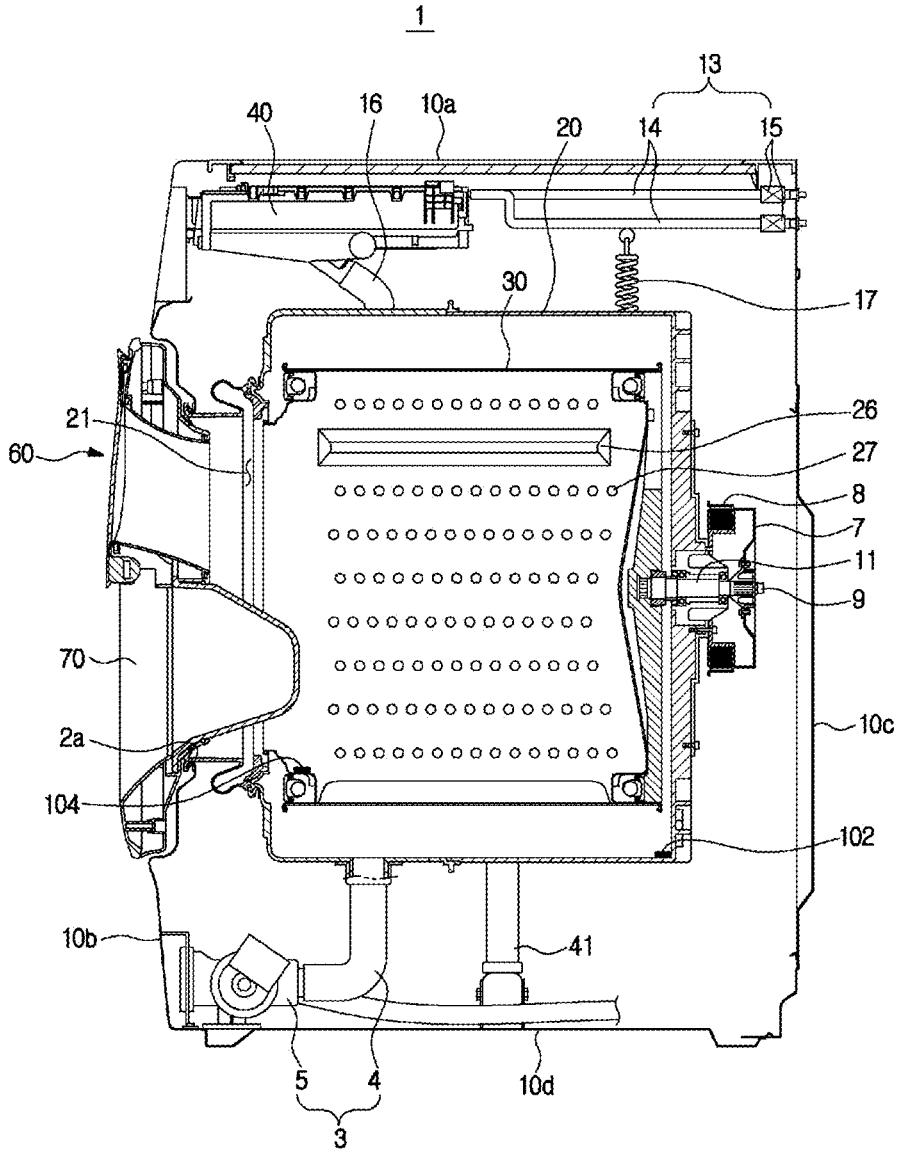
FIG. 4 is a cross-sectional view of a configuration of the washing machine according to an embodiment of the present disclosure.

FIG. 1 is a perspective view of an exterior of a washing machine according to one embodiment of the present disclosure, FIG. 2 is a perspective view of a state in which a main door of the washing machine according to one embodiment of the present disclosure is opened, FIG. 3 is a perspective view of a state in which an auxiliary door of the washing machine according to one embodiment of the present disclosure is opened, and FIG. 4 is a cross-sectional view of a configuration of the washing machine according to one embodiment of the present disclosure.

Referring to FIGS. 1 to 4, a washing machine 1 includes a main body 10 that has an approximately box shape and forms an exterior of the washing machine 1, a tub 20 that accommodates water (washing water or rinsing water) to be used in a wash or rinse cycle, a drum 30 that accommodates laundry, and a motor 7 that rotates the drum 30.

A control panel 80 on which various buttons for controlling the washing machine 1 and a display are disposed, is disposed on an upper front surface of the main body 10, and inputters 81*a* and 81*b* through which operation instructions of a user are input to the washing machine 1 so as to control operation of the washing machine 1, and a display 83 for displaying an operating state of the washing machine 1 and a user's manipulation state are disposed on the control panel 80.

The inputters 81*a* and 81*b* may receive the user's instructions relating to the operation of the washing machine 1, such as a washing course, the number of times of rinsing, a spin dry time, a drying time, operation and pause, and the like, and employ a pressing button 81*a* or a rotating button 81*b*.

The display 83 displays information about the operation of the washing machine 1, such as the amount of washing water, a cycle performed by the washing machine 1, a remaining time until washing is finished, and the like. The display 83 may be implemented with a liquid crystal display (LCD) panel, a light-emitting diode (LED) panel, etc.

The washing machine 1 according to one embodiment of the present disclosure includes the inputters 81*a* and 81*b* and the display 83 separately, but the present disclosure is not limited thereto, and the inputters 81*a* and 81*b* and the display 83 may be integrally formed by employing a touch screen panel (TSP) through which manipulation instructions are input by a user and on which operation information corresponding to the input manipulation instructions is displayed.

Further, the main body 10 includes frames 10*a*, 10*b*, 10*c*, and 10*d*. The frames 10*a*, 10*b*, 10*c*, and 10*d* include a top frame 10*a* forming a top surface of the main body 10, a front frame 10*b* and a rear frame 10*c* forming front and rear surfaces of the main body 10, a side frame (not shown) and a bottom frame 10*d* connecting the front frame 10*b* to the rear frame 10*c* and forming sides and a bottom surface of the main body 10.

A laundry port 2*a* through which laundry may be put into the drum 30 is formed in the front frame 10*b* of the main body 10. The laundry port 2*a* is opened or closed by a main door 70 installed at the front frame 10*b* of the main body 10.

A diaphragm 90 may connect the main body 10 to the tub 20. The diaphragm 90 may be disposed between the laundry port 2*a* of the front frame 10*b* and an opening 21 of the tub 20, may form a path from the laundry port 2*a* of the front frame 10*b* to the opening 21 of the tub 20, and may lessen vibrations transferred to the front frame 10*b* when the drum 30 is rotated. Also, a part of the diaphragm 90 is disposed between the main door 70 and the front frame 10*b* so as to prevent water in the tub 20 from leaking to an outside of the main body 10.

The diaphragm 90 may be formed as an injection molded material with a thermoplastic elastomer. Because a thermoplastic elastomer has elasticity at room temperature, like rubber, the diaphragm 90 formed of the thermoplastic elastomer may effectively lessen vibrations transferred from the tub 20 to the front frame 10*b* of the main body 10.

A spring 17 may be disposed between the tub 20 and the main body 10 so as to support the tub 20 from an upper side thereof. The spring 17 lessens vibrations and noise generated due to movement of the tub 20 by elasticity.

A water supply 13 for supplying water into the tub 20 and a detergent supply unit 40 for supplying a detergent and a fabric softener into the tub 20 are installed at an upper portion of the tub 20.

The water supply 13 includes a water supply pipe 14 that connects an external water supply pipe to the detergent supply unit 40 so as to supply water (washing water or rinsing water) into the tub 20, and a water supply valve 15 that opens or closes the water supply pipe 14 to control supplying of hot or cold water.

The detergent supply unit 40 is connected to the tub 20 via a connection pipe 16 connected to a lower portion thereof. The detergent and the fabric softener inside the detergent supply unit 40 pass through the detergent supply unit 40 and are supplied into the tub 20 together with water using the water supply 13 connected to the tub 20. This configuration enables water supplied into the tub 20 to pass through the detergent supply unit 40 and the detergent to be supplied into the tub 20 together with the water.

The tub 20 is supported by a damper 41. The damper 41 connects an inner bottom surface of the main body 10 to an outer surface of the tub 20. Also, the damper 41 may be disposed at an upper side or left and right sides of the main body 10 in addition to the inner bottom surface of the main body 10 so as to support the tub 20. The damper 41 or the spring 17 may lessen vibrations and impact generated due to vertical movement of the tub 20 at upper and lower sides of the tub 20.

The tub 20 may be supported by at least one damper 41.

A plurality of through holes 27 through which water (washing water or rinsing water) flows, are formed in the circumference of the drum 30. A plurality of lifters 26 are installed at an inner circumferential surface of the drum 30 so that, when the drum 30 is rotated, the laundry may ascend or descend.

A motor 7 for generating a driving force for rotating the drum 30 is installed at a rear surface of the tub 20. Generally, the motor 7 is a universal motor including a field coil and an armature, or a brushless direct (BLDC) motor including a permanent magnet and an electric magnet, and any motor that is capable of being applied to the drum 30 may be used. In addition, the motor 7 may be configured in a belt manner.

A driving shaft 11 for transferring the driving force of the motor 7 is installed between the drum 30 and the motor 7. One end of the driving shaft 11 is connected to a rear plate of the drum 30, and the other end of the driving shaft 11 extends outside of a rear wall of the tub 20. When the motor 7 drives the driving shaft 11, the drum 30 connected to the driving shaft 11 is rotated around the driving shaft 11.

A bearing housing 8 is installed at the rear wall of the tub 20 so as to rotatably support the driving shaft 11. The bearing housing 8 may be formed of an aluminum alloy and may be inserted into the rear wall of the tub 20 when the tub 20 is injection-molded. Bearings 9 are installed between the bearing housing 8 and the driving shaft 11 so that the driving shaft 11 may be smoothly rotated.

A drainage device 3 for discharging water inside the tub 20 to the outside of the main body 10 may be disposed below the tub 20. The drainage device 3 may include a drainage pipe 4 configured to guide water in the tub 20 toward the outside of the main body 10, and a drainage pump 5 configured to pump water from the tub 20. In one embodiment of the present disclosure, the drainage pump 5 is installed so as to discharge water. However, the embodiment of the present disclosure is not limited thereto, and a drainage motor or drainage valve may be installed.

The washing machine 1 according to one embodiment of the present disclosure may further include an auxiliary door 60 combined with the main door 70 so that the laundry may be additionally loaded through the auxiliary door 60 without opening the main door 70. One side of the auxiliary door 60 may be hinge-coupled to the main door 70.

The main door 70 and the auxiliary door 60 may be independently opened and closed. That is, as illustrated in FIG. 2, only the main door 70 may be opened, and as illustrated in FIG. 3, only the auxiliary door 60 may also be opened.

The main door 70 may be provided to be rotatable in a horizontal direction, and the auxiliary door 60 may be provided to be rotatable in a vertical direction. That is, a rotational axis of the main door 70 and a rotational axis of the auxiliary door 60 may be orthogonal to each other.

However, unlike this, the main door 70 and the auxiliary door 60 may be rotated in the same direction. That is, the rotational axis of the main door 70 and the rotational axis of the auxiliary door 60 may be parallel to each other. Furthermore, the rotational axis of the main door 70 and the rotational axis of the auxiliary door 60 may be disposed on the same line.

The auxiliary door 60 is disposed at an approximately upper portion of the main door 70. That is, when the auxiliary door 60 is opened or closed during operation of the washing machine 1, the auxiliary door 60 needs to be disposed at a higher position than a level of water stored in the tub 20 so that water (washing water or rinsing water) in the tub 20 can be prevented from overflowing.

Alternatively, when a left side or right side of the auxiliary door 60 is hinge-coupled to the main door 70, the auxiliary door 60 may be opened or closed in the horizontal direction. When an upper side or a lower side of the auxiliary door 60 is hinge-coupled to the main door 70, the auxiliary door 60 may be opened or closed in the vertical direction. Preferably, a lower side of the auxiliary door 60 may be hinge-coupled to the main door 70 so that the auxiliary door 60 may be opened or closed in a downward direction.

A locking part 71 may be formed at another side of the main door 70.

The locking part 71 of the main door 70 may be installed to be detachable from a main locking device 72 installed in the front frame 10*b* of the main body 10. That is, when the locking part 71 of the main door 70 is inserted into the main locking device 72 of the front frame 10*b*, the main door 70 is maintained in a closed state, and when the locking part 71 of the main door 70 is detached from the main locking device 72 of the front frame 10*b*, the main door 70 is maintained in an opened state.

A locking part 61 may be formed at another side of the auxiliary door 60.

The locking part 61 of the auxiliary door 60 may be installed to be detachable from an auxiliary locking part 62. That is, when the locking part 61 of the auxiliary door 60 is inserted into the auxiliary locking part 62 of the main door 70, the auxiliary door 60 is maintained in a closed state, and when the locking part 61 of the auxiliary door 60 is detached from the auxiliary locking part 62 of the main door 70, the auxiliary door 60 is maintained in an opened state.

One side of the auxiliary door 60 hinge-coupled to the main door 70 may face the other side of the auxiliary door 60 having the locking part 61 formed therein. That is, when the left side of the auxiliary door 60 is hinge-coupled to the main door 70, the locking part 61 may be formed in the right side of the auxiliary door 60. When a right side of the auxiliary door 60 is hinge-coupled to the main door 70, the locking part 61 may be formed in a left side of the auxiliary door 60. When an upper side of the auxiliary door 60 is hinge-coupled to the main door 70, the locking part 61 may be formed in a lower side of the auxiliary door 60. When the lower side of the auxiliary door 60 is hinge-coupled to the main door 70, the locking part 61 may be formed in the upper side of the auxiliary door 60.

The auxiliary door 60 is in a locked state during the operation of the washing machine 1, and when the locking state of the auxiliary door 60 is released, the drum 30 stops rotating.

Whether the auxiliary door 60 is locked or unlocked, that is, whether the auxiliary door 60 is opened or closed may be determined by a sensor (not shown). According to one embodiment of the present disclosure, whether the auxiliary door 60 is opened or closed may be determined by an optical sensor (not shown). The optical sensor may include a light emitter (not shown) in which a light-emitting direction varies according to movement of the auxiliary door 60, and a light receiver (not shown) that receives light emitted by the light emitter and outputs a signal having a magnitude corresponding to an amount of the received light. The controller 110 (see FIG. 5) analyzes the signal output by the light receiver, determines whether the auxiliary door 60 is opened or closed, and controls the rotation of the drum 30 according to the result of determination.

A method of determining whether the auxiliary door 60 is opened or closed, is not limited to the above example and may be modified in various ways.

Further, in the washing machine 1 according to one embodiment of the present disclosure, a water level sensor 102 configured to detect a frequency varying according to a water level so as to detect an amount (level) of water in the tub 20 is installed inside a lower side of the tub 20, and a temperature sensor 104 configured to detect a temperature inside the drum 30 is installed at a predetermined position in the drum 30.

Figure 5:
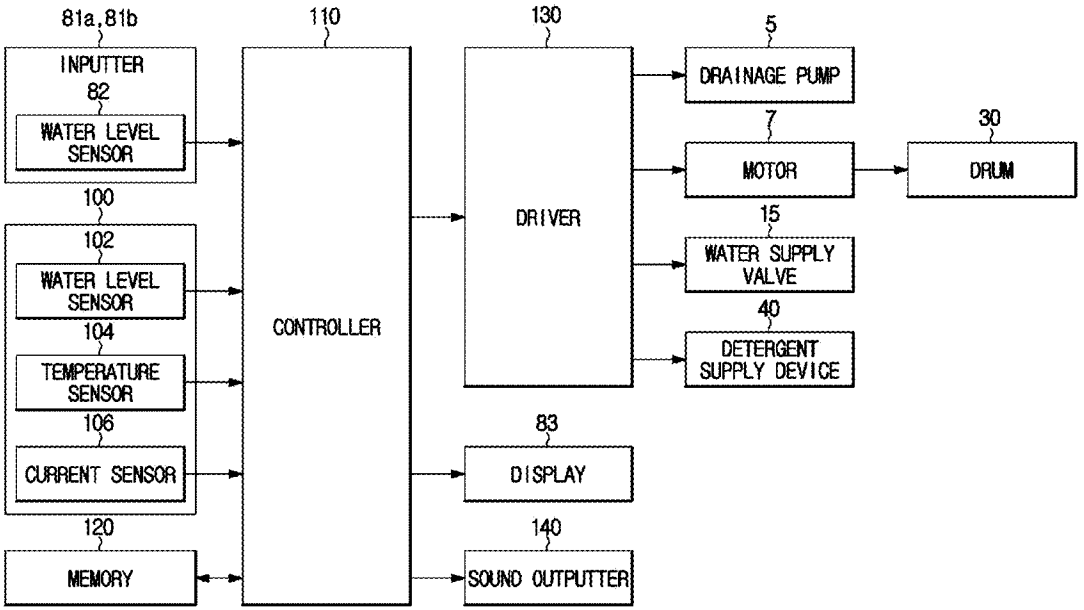
FIG. 5 is a control block diagram of the washing machine according to one embodiment of the present disclosure.

FIG. 5 is a control block diagram of a washing machine according to one embodiment of the present disclosure.

Referring to FIG. 5, the washing machine 1 according to an embodiment of the present disclosure includes the inputters 81*a* and 81*b*, the display 83, a detector 100, the controller 110, a memory 120, a driver 130, and a sound outputter 140.

The inputters 81*a* and 81*b* through which instructions for performing a wash cycle, a rinse cycle and a spin dry cycle of the washing machine 1 by the user's manipulation are input, may be keys, buttons, switches, or touch pads and include all devices configured to generate predetermined input data by manipulation such as pressing, touch, pressure, rotation, or the like.

Further, the inputters 81*a* and 81*b* are disposed on the control panel 80 and include a plurality of buttons (power, reservation, temperature of washing water, soaking, washing, rinsing, spin dry, a selection level, and the like) through which the user's instructions relating to the operation of the washing machine 1 are input. The plurality of buttons include a course selection button for selecting a washing course from a plurality of washing courses including a standard course, a wool course, a steaming course, a drying course, and the like according to the type of laundry to be put into the washing machine 1.

Further, a laundry addition button 82 for additionally loading laundry during the operation of the washing machine 1 is disposed in the inputters 81*a* and 81*b*.

The laundry addition button 82 is a button disposed to open and close the auxiliary door 60 during the operation of the washing machine 1 so that laundry may be additionally put into the washing machine.

The user can manipulate the laundry addition button 82 to additionally put laundry into the washing machine during the operation of the washing machine 1, that is, during a wash, rinse or spin dry cycle.

The display 83 displays an operating state of the washing machine 1 according to a display control signal of the controller 110 and recognizes operation information input through the inputters 81*a* and 81*b* to display whether laundry can be additionally loaded or not.

Further, the display 83 displays whether laundry may be additionally put into the washing machine during the operation of the washing machine 1 according to the operational signal of the laundry addition button 82. First, in the case of a course in which laundry may be additionally loaded (for example, a standard course, a fine course, a wool course, and the like), the display 83 displays a state in which laundry may be additionally loaded using text, or the display 83 is lit so that the user may easily check the state in which laundry may be additionally loaded.

Meanwhile, in the case of a course in which laundry may not be additionally loaded (for example, a steaming course, a drying course, and the like), the display 83 displays a state in which laundry may not be additionally loaded using text, or the display 83 flashes so that the user may easily check the state in which laundry may not be added.

In this way, the display 83 that is an LCD user interface (UI) on which an icon or text may be denoted, displays the operating state (for example, whether laundry may be additionally loaded or not) of the washing machine 1 by the icon or text so that the user can take a proper action.

Further, the display 83 that is an LED UI displays the operating state (for example, whether laundry may be additionally loaded or not) of the washing machine 1 using light on or off and a difference in duration time so that the user can recognize an abnormal state of the washing machine 1.

The detector 100 includes the water level sensor 102 installed inside the lower side of the tub 20 and configured to detect the amount (level) of water in the tub 20, the temperature sensor 104 that is installed inside the drum 30 and detects an air temperature of the inside of the drum 30, that is, a temperature of the inside of the drum, and a current sensor 106 configured to measure a current flowing through the motor 7 to detect whether the drum is being rotated, which are various sensors installed in the washing machine 1 so as to detect the temperature inside the drum 30, whether the drum is being rotated and the level of water in the tub 20 for safe operation of the auxiliary door 60.

Meanwhile, in one embodiment of the present disclosure, the current flowing through the motor 7 is measured to detect whether the drum is being rotated. However, the embodiment of the present disclosure is not limited thereto, and even when a voltage applied to the motor 7 is measured so that whether the drum is being rotated is detected, of course, the same objectives and effects as those of the present disclosure can be achieved.

The controller 110 that is a microcomputer for controlling overall operation of the washing machine 1, such as a wash cycle, a rinse cycle and a spin dry cycle, according to operation information input from the inputters 81*a* and 81*b*, sets a washing amount (target washing level) and rinsing amount (target rinsing level), target revolutions per minute (RPM), a motor operation rate (washing motor on-off time), a washing time and the number of times of rinsing according to the weight (load amount) of laundry in a selected washing course.

Further, the controller 110 provides an algorithm for safely operating the auxiliary door 60 through which laundry may be additionally put into the washing machine according to manipulation of the laundry addition button 82.

This will now be described in more detail.

When a user manipulates the laundry addition button 82, the controller 110 determines whether it is a course in which laundry may be additionally loaded (for example, a standard course, a fine course, a wool course, and the like) and displays the result of determination on the display 83.

First, in the case of a course in which laundry may be additionally loaded (for example, a standard course, a fine course, a wool course, and the like), the display 83 is lit or text is displayed by the display 83 so that the user may easily check the state in which laundry may be additionally loaded.

Meanwhile, in the case of a course in which laundry may not be additionally loaded (for example, a steaming course, a drying course, and the like), the display 83 flashes, or text is displayed by the display 83 so that the user may easily check the state in which laundry may not be added.

Accordingly, the user confirms the course is a course in which laundry may be additionally loaded through the display 83 and additionally puts the laundry into the washing machine.

Next, the controller 110 checks rotation of the drum 30, the temperature inside the drum 30, and a level of water stored in the tub 20 to operate the auxiliary door 60 to perform control so that laundry is more safely put into the washing machine.

That is, when the temperature inside the drum 30 is lower than a set temperature (a proper temperature at which the risk of an accident can be prevented, about 70° C.), the rotation operation of the drum 30 is stopped, and the level of water in the tub 20 is lower than a set water level (an overflow level at which water inside the tub may flow in an outward direction), the controller 110 unlocks the auxiliary door 60 so that the auxiliary door 60 may be opened.

Further, when laundry is additionally put into the washing machine, the controller 110 changes a cycle profile according to each of the wash cycle, rinse cycle and spin dry cycle, and compensates the cycle profile according to a time when laundry is additionally loaded.

This will now be described in more detail.

First, when laundry is additionally loaded during the wash cycle, a wash cycle time is adjusted according to the time elapsed from the time of adding the laundry. For example, when the time of adding the laundry is within a predetermined time (about 10 minutes) after starting the wash cycle, a subsequent wash cycle is continued without changing a set washing time. On the other hand, when the laundry is added after a predetermined time (about 10 minutes) has elapsed since the wash cycle has started, the set washing time is compensated with a predetermined time and the subsequent wash cycle proceeds. Here, the compensation time does not exceed the predetermined time (about 10 minutes) so that the inconvenience the user may feel due to a prolonged washing time is reduced.

Meanwhile, in one embodiment of the present disclosure, a wash cycle time is prolonged when laundry is additionally loaded during the wash cycle. However, the embodiment of the present disclosure is not limited thereto, and washing RPM may be adjusted to compensate washing performance according to addition of the laundry without extending the wash cycle time. Further, both the wash cycle time and the washing RPM may be adjusted to compensate washing performance according to addition of the laundry.

In addition, a detergent may be added through the detergent supply unit 40 when laundry is additionally loaded during the wash cycle.

Next, when laundry is additionally loaded during the rinse cycle, the number of times of rinsing or a rinsing time is adjusted according to the number of times of rinsing carried out at a time of adding the laundry. For example, when the number of times of rinsing carried out at the time of adding the laundry is one, a subsequent rinse cycle is continued without changing a set number of times of rinsing. On the other hand, when the number of times of rinsing carried out at the time of adding the laundry is two or more, a subsequent rinse cycle is continued after the set number of times of rinsing is compensated with one more time of rinsing to increase the number of times of rinsing, or a rinsing time of the last rinsing is compensated with a predetermined time.

In addition, when laundry is additionally loaded during the rinse cycle, the number of times of rinsing or the rinsing time is adjusted according to the remaining number of times of rinsing at a time of adding the laundry. For example, when the remaining number of times of rinsing at the time of adding the laundry is one, a subsequent rinse cycle is continued after the set number of times of rinsing is compensated with one more time of rinsing to increase the number of times of rinsing, or a rinsing time of the last rinsing is compensated with a predetermined time. On the other hand, when the remaining number of times of rinsing at the time of adding the laundry is not one (for example, two or more), a subsequent rinse cycle is continued without changing a set number of times of rinsing, or a subsequent rinse cycle is continued without compensating a rinsing time of the last rinsing.

Meanwhile, in one embodiment of the present disclosure, the number of times of rinsing is increased or a rinse cycle time is prolonged when laundry is additionally loaded during the rinse cycle. However, the embodiment of the present disclosure is not limited thereto, and rinsing performance according to addition of the laundry may be compensated by adjusting rinsing RPM without increasing the number of times of rinsing or extending the rinse cycle time. Further, the number of times of rinsing and the rinsing RPM may be adjusted to compensate rinsing performance according to addition of the laundry, and the rinse cycle time and the rinsing RPM may be adjusted to compensate rinsing performance according to addition of the laundry.

Next, when the laundry is additionally loaded during the spin dry cycle, a subsequent spin dry cycle is continued without changing a spin dry time or spin dry RPM.

Meanwhile, in one embodiment of the present disclosure, the spin dry cycle is continued without changing the spin dry cycle profile when laundry is additionally loaded during the spin dry cycle. However, embodiments of the present disclosure are not limited thereto, and the spin dry RPM may be checked to prevent additional laundry from being put into the washing machine through sound output or visual display in the case of excessive RPM or maximum RPM.

Setting information such as control data for controlling the operation of the washing machine 1, reference data used during control of the operation of the washing machine 1, operation data generated while the washing machine 1 performs a predetermined operation, and set data input by the inputters 81*a* and 81*b* so that the washing machine 1 performs the predetermined operation, use information including the number of times which the washing machine 1 performs the predetermined operation, and information about a model of the washing machine 1, and failure information including a malfunction cause or malfunction location when a malfunction of the washing machine 1 occurs, may be stored in the memory 120.

Further, a control value for a temperature inside the drum 30 and a control value for the level of water in the tub 20 according to additional loading conditions of the laundry determined by the controller 110 may be stored in the memory 120, and a control program for controlling the washing machine 1 and a program such as an exclusive-use application initially provided by a manufacturer or a general-use application downloaded from the outside may be stored in the memory 120.

In addition, the memory 120 may be implemented with a read only memory (ROM), a programmable read only memory (PROM), an erasable programmable read only memory (EPRM), a non-volatile memory device such as a flash memory, a volatile memory device such as a random access memory (RAM), or a storage device such as a hard disk or an optical disk. However, the memory 120 is not limited thereto, and various storage devices that may be considered by a designer may be used.

The driver 130 drives the drainage pump 5, the motor 7, the water supply valve 15, and the detergent supply unit 40 relating to the operation of the washing machine 1 according to a driving control signal of the controller 110.

The sound outputter 140 outputs an operating state of the washing machine 1 and the user's manipulation state as a sound (for example, a beep sound) according to a sound control signal of the controller 110.

Hereinafter, an operating procedure and effects of the washing machine including the auxiliary door 60 according to one embodiment of the present disclosure and a method of controlling the same will be described.

Figure 6A:
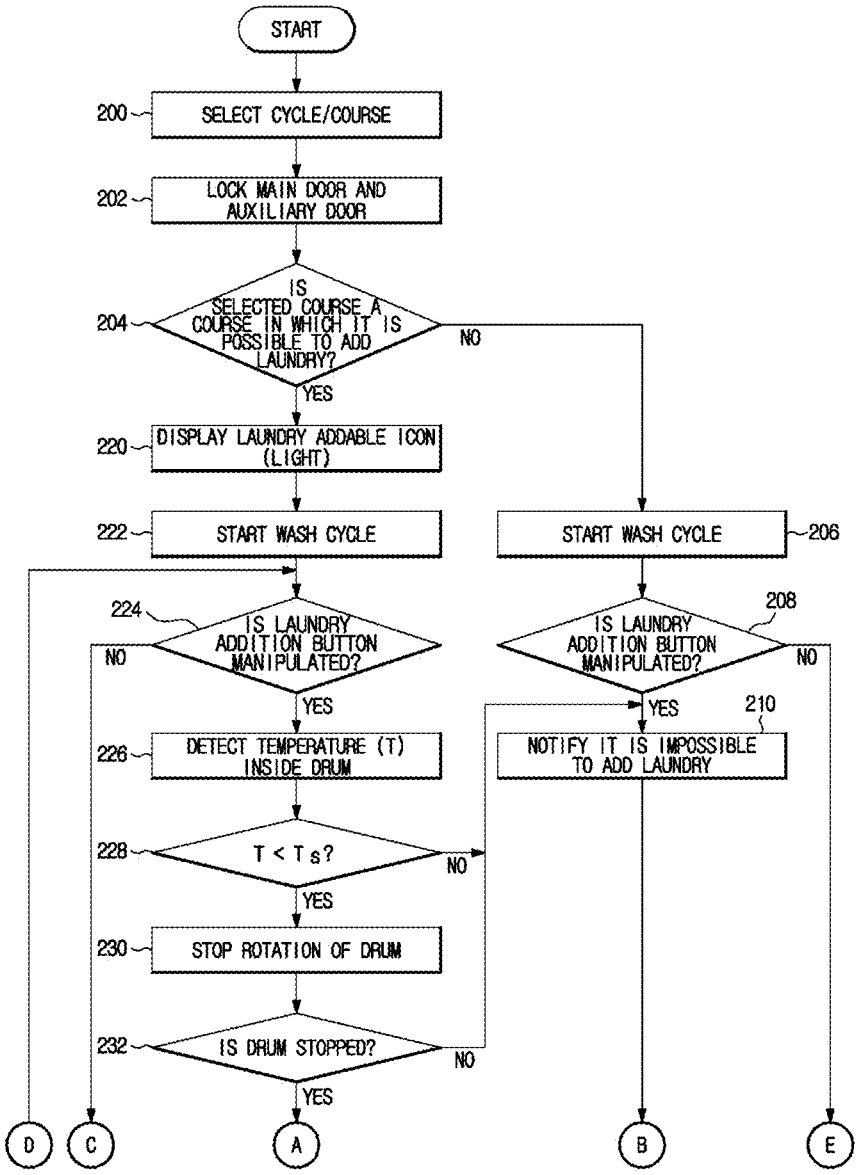
FIGS. 6A and 6B are operational flowcharts of a first control algorithm for operation of the auxiliary door in the washing machine according to one embodiment of the present disclosure.
Figure 6B:
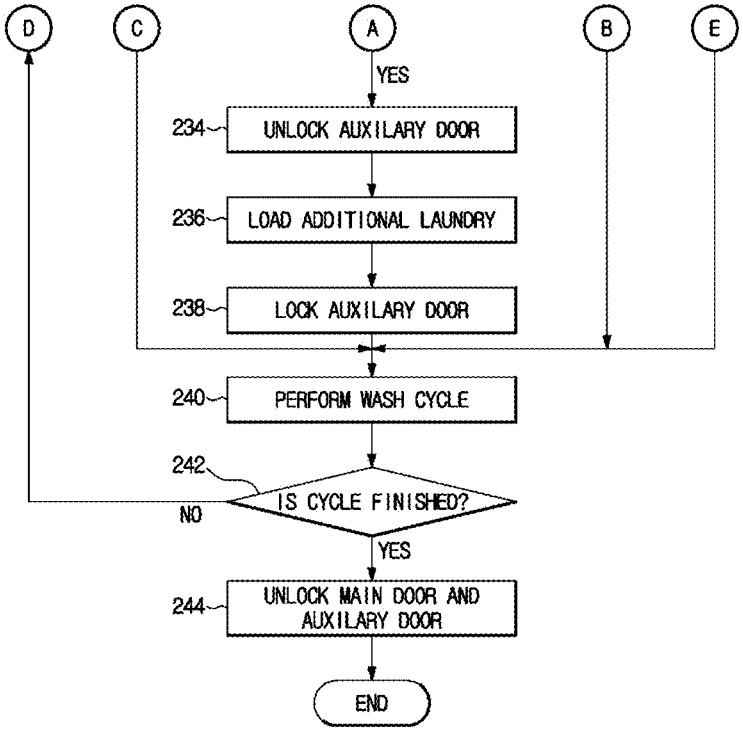

FIGS. 6A and 6B are operational flowcharts of a first control algorithm for operation of the auxiliary door in the washing machine according to one embodiment of the present disclosure.

Referring to FIGS. 6A and 6B that illustrate an algorithm for safely operating the auxiliary door 60 separately provided from the main door 70, a method of safely operating the auxiliary door 60 by manipulating the laundry addition button 82 when laundry is to be additionally loaded during the operation of the washing machine 1 will be described.

In FIGS. 6A and 6B, a user opens the main door 70 or the auxiliary door 60 and puts laundry into the drum 30 through the laundry port 2*a*, closes the main door 70 or the auxiliary door 60, selects a washing course from a plurality of washing courses including a standard course, a wool course, a fine course, a steaming course, and the like, and a cycle (200). Here, the operation information selected by the user is input to the controller 110 through the inputters 81*a* and 81*b*.

In addition, the user may manipulate the inputters 81*a* and 81*b* to select a drying course including a dry cycle according to the type of laundry. In this case, it is designed to carry out the dry cycle after completion of spin dry in connection with the wash cycle.

When an operation button is pressed after selecting the washing course and wash cycle, the controller 110 drives a locking device (not shown) to lock the main door 70 and the auxiliary door 60 (202).

When the main door 70 and the auxiliary door 60 are locked, the controller 110 determines whether the selected washing course is a course in which laundry can be additionally loaded (for example, a standard course, a fine course, a wool course, and the like) (204).

As a result of the determination in Operation 204, when it is determined to be a course in which laundry may not be additionally loaded (a steaming course, a drying course, and the like), the controller 110 starts to carry out a series of cycles of the washing machine 1 according to the operation information input from the inputters 81*a* and 81*b* (206). At this time, the display 83 flashes.

While the display 83 flashes, the controller 110 determines whether the laundry addition button 82 has been manipulated during progressing of the cycle of the washing machine 1 (208). This is to determine whether the user has pressed the laundry addition button 82 in the course in which laundry may not be additionally loaded.

When the laundry addition button 82 is manipulated while the display 83 flashes, the controller 110 outputs a sound (for example, a beep sound) through the sound outputter 140 to notify the user that the course is a course in which laundry may not be additionally loaded. Simultaneously, the display 83 flashes so that the user may easily check that the course is a course in which laundry may not be additionally loaded.

Meanwhile, as a result of the determination in Operation 204, when it is determined to be a course in which laundry may be additionally loaded (a standard course, a fine course, a wool course, and the like), the controller 110 allows the display 83 to be lit to display the course in which laundry can be additionally loaded using an icon or the like (202). Therefore, the user can confirm that the course is a course in which laundry can be additionally loaded.

Subsequently, the controller 110 starts to carry out a series of cycles of the washing machine 1 according to the operation information input from the inputters 81*a* and 81*b* (222).

While the display 83 is turned on, the controller 110 determines whether the laundry addition button 82 has been manipulated during progressing of the washing operation of the washing machine 1 (224). This is to determine whether the user has pressed the laundry addition button 82 on the course in which laundry may be additionally loaded.

As a result of the determination in Operation 224, when it is determined that the laundry addition button 82 has been manipulated, the controller 110 carries out an operation algorithm to confirm the temperature inside the drum 30 and whether the drum 30 is being rotated to determine whether it is safe to open the auxiliary door 60 before unlocking the auxiliary door 60.

To this end, the controller 110 detects a temperature T inside the drum 30 through the temperature sensor 104 (226), and determines whether the detected temperature T inside the drum 30 is lower than a set temperature Ts (a proper temperature at which the risk of an accident may be prevented, about 70° C.) (228). This is for the purpose of eliminating the risk of an accident such as burns caused by high temperature air inside the drum 30 when laundry is additionally loaded through the auxiliary door 60.

As a result of the determination in Operation 228, when it is determined that the temperature T inside the drum 30 is not lower than the set temperature Ts, the controller 110 determines, as an operation condition, that the auxiliary door 60 may not be opened because the temperature inside the drum 30 is high, and proceeds to Operation 210 to output a sound through the sound outputter 140 and allow the display 83 to flash to inform that laundry may not be additionally loaded.

Meanwhile, as a result of the determination in Operation 228, when it is determined that the temperature T inside the drum 30 is lower than the set temperature Ts, the controller 110 stops the rotation operation of the drum 30 through the driver 130 (230) and determines whether the drum 30 has stopped through the current sensor 106 (232). This is for the purpose of eliminating the risk of an accident such as being hurt by the rotation of the drum 30 when laundry is additionally loaded through the auxiliary door 60.

As a result of the determination in Operation 232, when it is determined that the drum 30 has not stopped, the controller 110 determines, as an operation condition, that the auxiliary door 60 may not be opened, and proceeds to Operation 210 to output a sound through the sound outputter 140 and allow the display 83 to flash to inform that laundry may not be additionally loaded.

Meanwhile, as a result of the determination in Operation 232, when it is determined that the drum 30 has stopped, the controller 110 unlocks the auxiliary door 60 (234).

When the auxiliary door 60 is unlocked, the user additionally loads laundry through the auxiliary door 60 (236) and closes the auxiliary door 60 so that the auxiliary door 60 can be locked again (238).

When the auxiliary door 60 is locked again, the controller 110 proceeds to subsequent cycles of the washing machine 1 cycle (specifically, a wash cycle, a rinse cycle and a spin dry cycle) (240).

Next, the controller 110 determines whether the cycle of the washing machine 1 is finished (242). When the cycle is not completed, the controller 110 determines whether the laundry addition button 82 has been manipulated, and proceeds with the subsequent cycles.

As a result of the determination in Operation 242, when it is determined that the cycle of the washing machine 1 has finished, the controller 110 unlocks the main door 70 and the auxiliary door 60 so that laundry may be taken out through the laundry port 2*a* (244).

Meanwhile, as a result of the determination in Operations 208 and 224, when it is determined that the laundry addition button 82 has not been manipulated, the controller 110 proceeds to Operation 240 and then proceeds to a subsequent cycle (specifically, a wash cycle, a rinse cycle and a spin dry cycle) of the washing machine 1.

FIGS. 6A and 6B illustrate the algorithm for confirming that an operation condition is a safe operation condition in which the auxiliary door 60 may be opened by checking the temperature inside the drum 30 and whether the drum 30 is being rotated, but the present disclosure is not limited thereto, and it is possible to implement an algorithm for checking the operation condition in which the auxiliary door 60 can be opened more safely by checking the water level of the tub 20 as well as checking the temperature inside the drum 30 and whether the drum 30 is being rotated. This will be described with reference to FIGS. 7A and 7B.

Figure 7A:
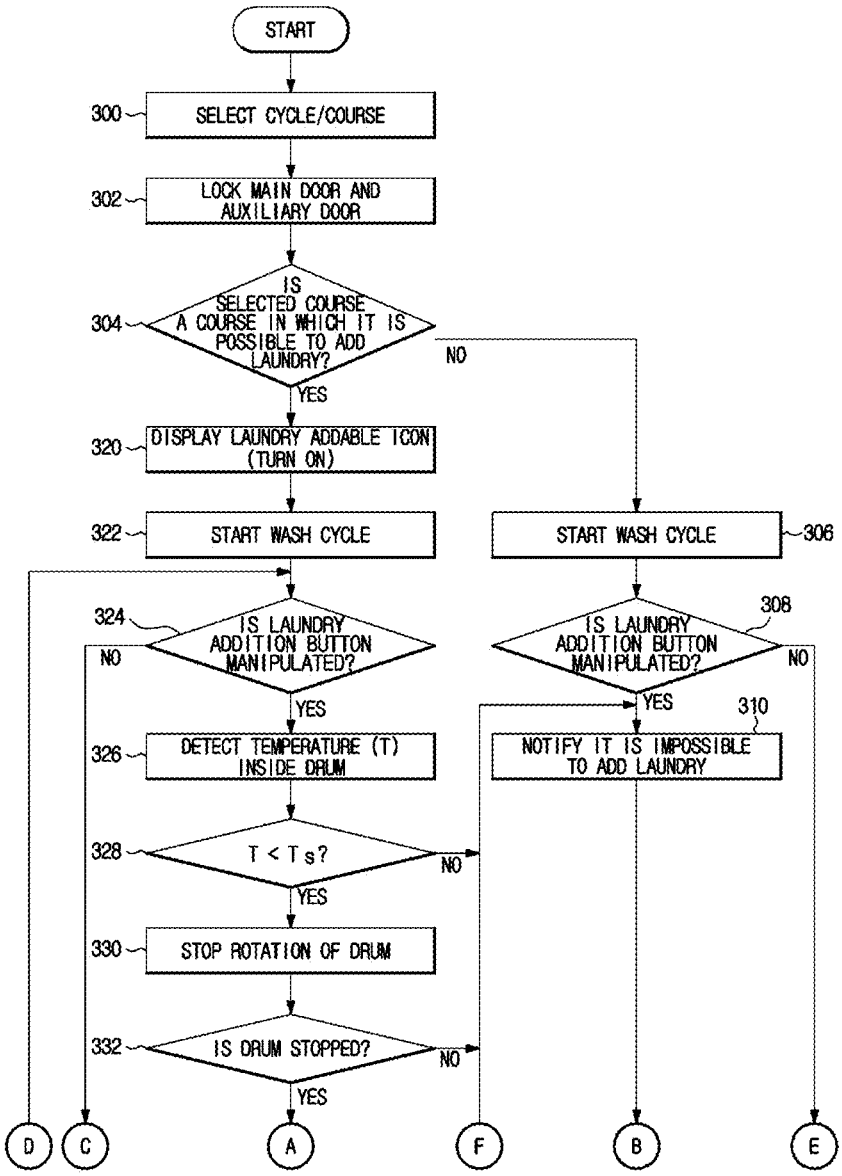
FIGS. 7A and 7B are operational flowcharts of a second control algorithm for operation of the auxiliary door in the washing machine according to one embodiment of the present disclosure.
Figure 7B:
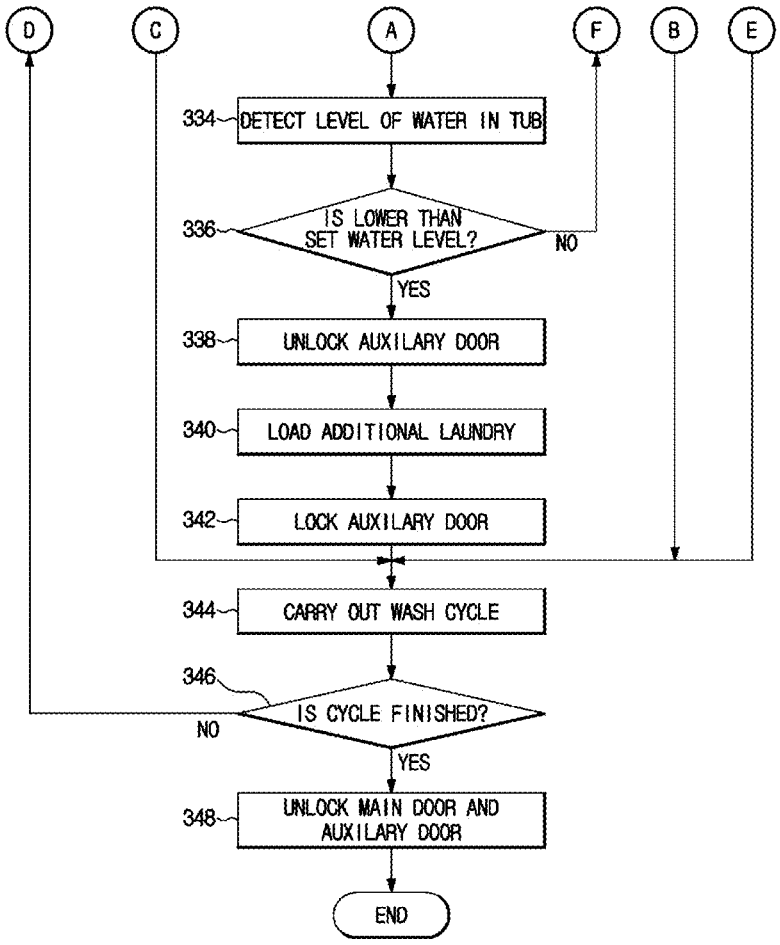

FIGS. 7A and 7B are operational flowcharts of a second control algorithm for an operation of the auxiliary door in the washing machine according to one embodiment of the present disclosure. Since FIGS. 6A and 6B are denoted by the same names and the same reference numerals, a repetitive description will be omitted as much as possible.

In FIGS. 7A and 7B, a user opens the main door 70 or the auxiliary door 60 to put the laundry into the drum 30, closes the main door 70 or the auxiliary door 60 and selects a washing course and a wash cycle (300).

When the operation button is pressed after the washing course and cycle has been selected, the controller 110 locks the main door 70 and the auxiliary door 60 (302).

When the main door 70 and the auxiliary door 60 are locked, the controller 110 determines whether the selected washing course is a course in which laundry may be additionally loaded (a standard course, a fine course, a wool course, and the like) (304).

As a result of the determination in Operation 304, when it is determined to be a course in which the laundry may not be additionally loaded (for example, a steaming course, a drying course, and the like), the controller 110 starts to carry out a series of cycles of the washing machine 1 while the display 83 is not turned on (306).

While the display 83 is turned off, the controller 110 determines whether the laundry addition button 82 has been manipulated during progressing of the cycle of the washing machine 1 (308).

When the laundry addition button 82 is manipulated while the display 83 is turned off, the controller 110 outputs a sound through the sound outputter 140 and allows the display 83 to flash to inform the user of the state in which laundry may not be added (310).

Meanwhile, as a result of the determination in Operation 304, when it is determined to be a course in which laundry can be additionally loaded (a standard course, a fine course, a wool course, and the like), the controller 110 allows the display 83 to be turned on to display the course in which laundry may be additionally loaded using an icon or the like (320).

Subsequently, the controller 110 starts to carry out a series of cycles of the washing machine 1 according to the input operation information (322).

While the display 83 is turned on, the controller 110 determines whether the laundry addition button 82 has been manipulated during progressing of the cycle of the washing machine 1 (324).

As a result of the determination in Operation 324, when it is determined that the laundry addition button 82 has been manipulated, the controller 110 carries out an operation algorithm to check the temperature inside the drum 30, whether the drum 30 is being rotated and the water level of the tub 20 to determine whether it is safe to open the auxiliary door 60 before unlocking the auxiliary door 60.

To this end, the controller 110 detects the temperature T inside the drum 30 (326), and determines whether the detected temperature T inside the drum 30 is lower than the set temperature Ts (328). This is for the purpose of eliminating the risk of an accident such as burns caused by high temperature air inside the drum 30 when laundry is additionally loaded through the auxiliary door 60.

As a result of the determination in Operation 328, when it is determined that the detected temperature T inside the drum 30 is not lower than the set temperature Ts, the controller 110 determines, as an operation condition, that auxiliary door 60 may not be opened, and proceeds to Operation 310 to output a sound through the sound outputter 140 and allow the display 83 to flash to inform that laundry may not be additionally loaded.

Meanwhile, as a result of the determination in Operation 328, when it is determined that the detected temperature T inside the drum 30 is lower than the set temperature Ts, the controller 110 stops the rotation operation of the drum 30 (330), and determines whether the drum 30 is stopped (332). This is for the purpose of eliminating the risk of an accident such as being hurt by the rotation of the drum 30 when laundry is additionally loaded through the auxiliary door 60.

As a result of the determination in Operation 332, when it is determined that the drum 30 has not stopped, the controller 110 determines, as an operation condition, that the auxiliary door 60 may not be opened, and proceeds to Operation 310 to output a sound through the sound outputter 140 and allow the display 83 to flash to inform that laundry may not be additionally loaded.

Meanwhile, as a result of the determination in Operation 332, when it is determined that the drum 30 has stopped, the controller 110 detects the level of water in the tub 20 through the water level sensor 102 (334), and determines whether the detected level of water in the tub 20 is lower than a set water level (336). This is for the purpose of preventing the water of the tub 20 from overflowing to the outside through the auxiliary door 60 when the auxiliary door 60 is opened. Generally, since the set water level is positioned below the auxiliary door 60, there is almost no overflow even when the water level of the tub 20 is not detected.

As a result of the determination in Operation 334, when it is determined that the detected level of water in the tub 20 is not lower than the set water level, the controller 110 determines, as an operation condition, that the auxiliary door 60 may not be opened, and proceeds to Operation 310 to output a sound through the sound outputter 140 and allow the display 83 to flash to inform that laundry may not be additionally loaded.

In one embodiment of the present disclosure, a state in which laundry may not be additionally loaded is notified when the level of water in the tub 20 is not lower than the set water level. However, the embodiment of the present disclosure is not limited thereto, and the auxiliary door 60 may be configured to be opened after the level of water in the tub 20 is lowered by a draining operation so that laundry may be additionally loaded.

Meanwhile, as a result of the determination in Operation 336, when it is determined that the level of water in the tub 20 is lower than the set water level, the controller 110 determines, as an operation condition, that the auxiliary door 60 can be opened, and unlocks the auxiliary door 60 (338).

When the auxiliary door 60 is unlocked, the user loads the laundry through the auxiliary door 60 (340), and closes the auxiliary door 60 to lock the auxiliary door 60 again (342).

When the auxiliary door 60 is locked again, the controller 110 proceeds to a subsequent cycle (specifically, a wash cycle, a rinse cycle and a spin dry cycle) of the washing machine 1 (344).

Subsequently, the controller 110 determines whether the cycle of the washing machine 1 is finished (346). When it is determined that the cycle has not finished, the controller 110 feedbacks to Operation 324 to determine whether the laundry addition button 82 is manipulated and proceeds to a subsequent cycle.

As a result of the determination in Operation 346, when it is determined that the cycle of the washing machine 1 has finished, the controller 110 unlocks the main door 70 and the auxiliary door 60 so that the laundry can be taken out through the laundry port 2*a* (348).

Meanwhile, as a result of the determination in Operations 308 and 324, when it is determined that the laundry addition button 82 has not been manipulated, the controller 110 proceeds to Operation 344 and then proceeds to a subsequent cycle (specifically, a wash cycle, a rinse cycle and a spin dry cycle) of the washing machine 1.

FIGS. 6A and 6B and FIGS. 7A and 7B illustrate that laundry is additionally loaded through the auxiliary door 60. However, the embodiment of the present disclosure is not limited thereto, and the laundry may be additionally loaded through both the main door 70 and the auxiliary door 60. This will be described with reference to FIGS. 8A and 8B.

Figure 8A:
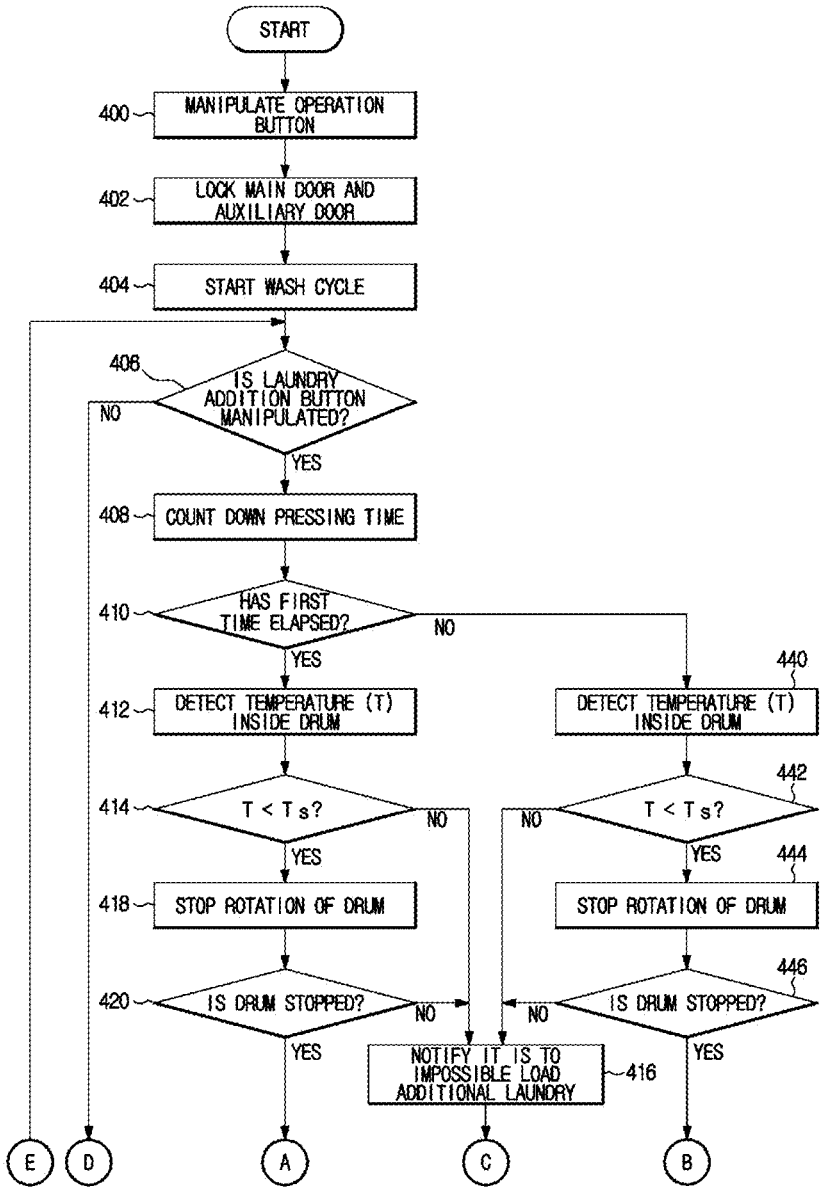
FIGS. 8A and 8B are operational flowcharts of a control algorithm for operation of the main door and the auxiliary door in the washing machine according to one embodiment of the present disclosure.
Figure 8B:
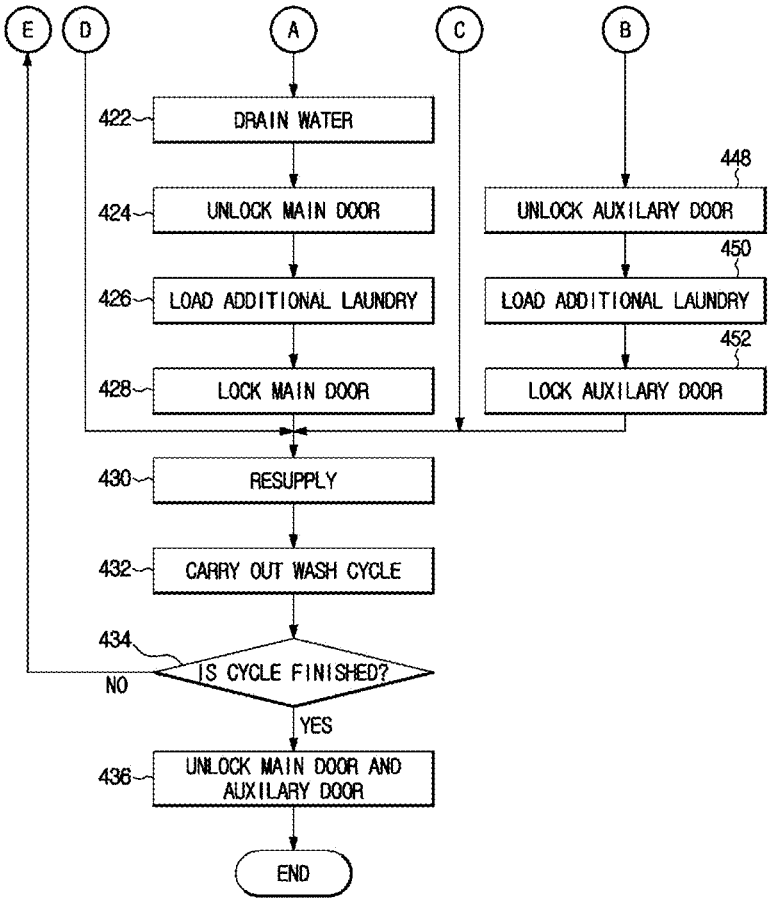

FIGS. 8A and 8B are operational flowcharts of a control algorithm for operation of the main door and the auxiliary door in the washing machine according to one embodiment of the present disclosure. Since FIGS. 6A and 6B are denoted by the same names and the same reference numerals, a repetitive description will be omitted as much as possible.

Referring to FIGS. 8A and 8B that illustrate an algorithm for safely operating the main door 70 and the auxiliary door 60, a method of safely operating the main door 70 and the auxiliary door 60 by manipulating the laundry addition button 82 when laundry is to be additionally loaded during the operation of the washing machine 1 will be described.

In FIGS. 8A and 8B, a user opens the main door 70 or the auxiliary door 60 to load laundry into the drum 30 and then closes the main door 70 or the auxiliary door 60. Thereafter, when the operation information related to the washing course and the operation of the washing machine 1 is input by manipulating the inputters 81*a* and 81*b* and then the operation button is manipulated (400), the operation information selected by the user is input to the controller 110 through the inputters 81*a* and 81*b*.

Accordingly, the controller 110 locks the main door 70 and the auxiliary door 60 using a main locking device 72 and an auxiliary locking device 62 (402).

When the main door 70 and the auxiliary door 60 are locked, the controller 110 starts to carry out a series of cycles of the washing machine 1 according to the operation information input from the inputters 81*a* and 81*b* (404).

The controller 110 determines whether the laundry addition button 82 has been manipulated during progressing of the cycle of the washing machine 1 (406).

As a result of the determination in Operation 406, when it is determined that the laundry addition button 82 has been manipulated, the controller 110 counts down a time of pressing the laundry addition button 82 (408), and determines whether a first time (the time for determining whether to open the main door or the auxiliary door to add laundry) has elapsed (410).

When the first time has elapsed, the controller 110 carries out an operation algorithm to check the temperature inside the drum 30 and whether the drum 30 is being rotated to determine whether it is safe to open the main door 70 before unlocking the main door 70.

To this end, the controller 110 detects the temperature T inside the drum 30 through the temperature sensor 104 (412), and determines whether the detected temperature T inside the drum 30 is lower than the set temperature Ts (414). This is for the purpose of eliminating the risk of an accident such as burns caused by high temperature air inside the drum 30 when laundry is additionally loaded through the main door 70.

As a result of the determination in Operation 414, when it is determined that the detected temperature T inside the drum 30 is not lower than the set temperature Ts, the controller 110 determines, as an operation condition, that the main door 70 may not be opened because the temperature inside the drum 30 is high, and outputs a sound (for example, a beep sound) through the sound outputter 140 to inform the user that laundry may not be additionally loaded. Simultaneously, the display 83 flashes so that the user may easily check the state in which laundry may not be additionally loaded (416).

Meanwhile, as a result of the determination in Operation 414, when it is determined that the detected temperature T inside the drum 30 is lower than the set temperature Ts, the controller 110 stops the rotation operation of the drum 30 through the driver 130 (418) and determines whether the drum 30 has stopped through the current sensor 106 (420). This is for the purpose of eliminating the risk of an accident such as being hurt by the rotation of the drum 30 when laundry is additionally loaded through the main door 70.

As a result of the determination in Operation 420, when it is determined that the drum 30 has not stopped, the controller 110 determines, as an operation condition, that the main door 70 may not be opened, and proceeds to Operation 426 to output a sound through the sound outputter 140 and allow the display 83 to flash to inform that laundry may not be additionally loaded.

Meanwhile, as a result of the determination in Operation 420, when it is determined that the drum 30 has stopped, the controller 110 determines, as an operation condition, that the main door 70 can be opened, the water in the tub 20 is drained through the drainage device 3 to a certain level (a proper water level at which overflow does not occur even when the main door is opened) before unlocking the main door 70 (422). This is for the purpose of preventing the water of the tub 20 from overflowing to the outside through the main door 70 when the main door 70 is opened.

After draining water in the tub 20, the controller 110 unlocks the main door 70 (424).

When the main door 70 is unlocked, laundry is additionally loaded through the main door 70 (426), the main door 70 is closed to lock the main door 70 again (428).

When the main door 70 is locked again, the controller 110 resupplies water to the inside of the tub 20 through the water supply 13 to adjust the level of water, lowered through a drain operation of Operation 422, in the tub 20 to an original water level (430).

When the water is resupplied into the tub 20, the controller 110 proceeds to a subsequent cycle (specifically, a wash cycle, a rinse cycle and a spin dry cycle) of the washing machine 1 (432).

Subsequently, the controller 110 determines whether the cycle of the washing machine 1 is finished (434). When it is determined that the cycle is not finished, the controller 110 feedbacks to Operation 406, and determines whether the laundry addition button 82 has been manipulated and proceeds to a subsequent cycle.

As a result of the determination in Operation 434, when it is determined that the cycle of the washing machine 1 has finished, the controller 110 unlocks the main door 70 and the auxiliary door 60 so that the laundry may be taken out through the laundry port 2*a* (436).

Meanwhile, as a result of the determination in Operation 406, when it is determined that the laundry addition button 82 has not been manipulated, the controller 110 proceeds to Operation 432 and then proceeds to a subsequent cycle (specifically, a wash cycle, a rinse cycle and a spin dry cycle) of the washing machine 1.

Meanwhile, as a result of the determination in Operation 410, when it is determined that the first time has elapsed, the controller 110 carries out an operation algorithm to confirm the temperature inside the drum 30 and whether the drum 30 is being rotated to determine whether it is safe to open the auxiliary door 60 before unlocking the auxiliary door 60.

To this end, the controller 110 detects the temperature T inside the drum 30 through the temperature sensor 104 (440), and determines whether the detected temperature T inside the drum 30 is lower than the set temperature Ts (442). This is for the purpose of eliminating the risk of an accident such as burns caused by high temperature air inside the drum 30 when laundry is additionally loaded through the auxiliary door 60.

As a result of the determination in Operation 442, when it is determined that the detected temperature T inside the drum 30 is not lower than the set temperature Ts, the controller 110 determines as an operation condition in which the auxiliary door 60 may not be opened because the temperature inside the drum 30 is high, and proceeds to Operation 426 to output a sound through the sound outputter 140 and allow the display 83 to flash to inform that the laundry may not be additionally loaded.

Meanwhile, as a result of the determination in Operation 442, when it is determined that the detected temperature T inside the drum 30 is lower than the set temperature Ts, the controller 110 stops the rotation operation of the drum 30 through the driver 130 (444) and determines whether the drum 30 has stopped through the current sensor 106 (446). This is for the purpose of eliminating the risk of an accident such as being hurt by the rotation of the drum 30 when laundry is additionally loaded through the auxiliary door 60.

As a result of the determination in Operation 446, when it is determined that the drum 30 has not stopped, the controller 110 determines, as an operation condition, that the auxiliary door 60 may not be opened, and proceeds to Operation 426 to output a sound through the sound outputter 140 and allow the display 83 to flash to inform that laundry may not be additionally loaded through the main door 70.

Meanwhile, as a result of the determination in Operation 446, when it is determined that the drum 30 has stopped, the controller 110 determines, as an operation condition, that the auxiliary door 60 may be opened, and unlocks the auxiliary door 60 (448).

When the auxiliary door 60 is unlocked, the user additionally loads laundry through the auxiliary door 60 (450) and closes the auxiliary door 60 so that the auxiliary door 60 may be locked again (452).

When the auxiliary door 60 is locked again, the controller 110 proceeds to Operation 432 and then proceeds to a subsequent cycle (specifically, a wash cycle, a rinse cycle and a spin dry cycle) of the washing machine 1. When the cycle has finished, the controller 110 unlocks the main door 70 and the auxiliary door 60 so that the laundry can be taken out through the laundry port 2*a*.

Next, a method of changing the cycle profile for each cycle when laundry is additionally loaded during the cycle of the washing machine 1 is performed will be described with reference to FIGS. 9 to 12.

Figure 9:
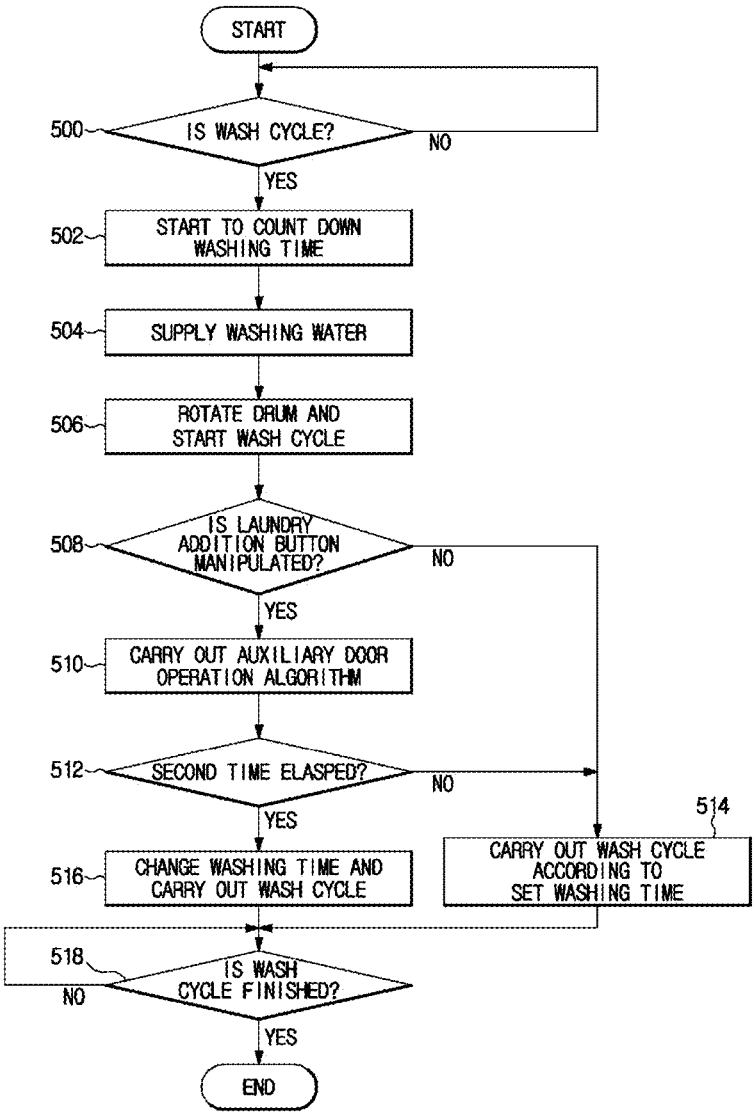
FIG. 9 is an operational flowchart of a control algorithm of a wash cycle profile in the washing machine according to one embodiment of the present disclosure.

FIG. 9 is an operational flowchart of a control algorithm of a wash cycle profile in the washing machine according to one embodiment of the present disclosure.

Referring to FIG. 9, when a user puts laundry into the drum 30 and inputs operation information relating to a washing course and the operation of the washing machine 1 according to the type of laundry, the operation information selected by the user is input to the controller 110 through the inputters 81*a* and 81*b*.

Thus, the controller 110 drives the motor 7 so as to detect the weight (loading amount) of the laundry put into the drum 30. A method of detecting the weight of the laundry by driving the motor 7 may be any one among a method of detecting the weight of the laundry using the time at which the motor 7 reaches a predetermined duty, and a value of an angular velocity by rotating the motor 7 with weight detection RPM (about 70 to 150 RPM) and giving the predetermined duty (90V) to the motor 7, a method of detecting the weight of the laundry using the time at which the motor 7 reaches a predetermined speed (or predetermined RPM) using instantaneous acceleration of the motor 7, and a method of detecting the weight of laundry using the second law of motion (torque=inertiax acceleration) after directly or indirectly measuring the amount of inertia of the drum 30 by giving a torque to the motor 7 for a predetermined time, as disclosed in Japanese Patent Laid-open Publication No. 2002-336593, Japanese Patent Laid-open Publication No. 2004-267334, and Japanese Patent Publication No. H07-90077.

In addition, it is obvious that the weight (loading amount) of the laundry may be detected using a load cell among well-known methods.

When the weight (loading amount) of the laundry is detected, the controller 110 sets motor RPM and an operation rate (a motor on-off time), a target washing level and a target rinsing level, a washing time and the number of times of rinsing according to the detected weight (loading amount) of the laundry.

Setting the motor RPM and operation rate (the motor on-off time), the target washing level and target rising level, the washing time and the number of times of rinsing according to the weight (loading amount) of laundry corresponds to a case in which the user does not input additional instructions relating to the operation of the washing machine 1. When the user additionally inputs the additional instructions relating to the operation of the washing machine 1, the motor RPM and the operation rate (the motor on-off time), the target washing level and the target rising level, the washing time and the number of times of rinsing set according to the weight of the laundry may be changed according to the user's instructions.

Subsequently, the controller 110 determines whether or not a cycle is a wash cycle (500). When the cycle is a wash cycle, the controller 110 starts to count down a washing time (502), and operates the water supply valve 15 and the detergent supply unit 40 through the driver 130 to supply water (washing water) required for the wash cycle.

When the water supply valve 15 is operated, the water supply valve 15 is opened so that water (washing water) supplied through an external water supply pipe is supplied to the tub 20 through the water supply pipe 14 and the detergent supply unit 40. Here, the detergent in the detergent supply unit 40 is dissolved in the supplied water (washing water) and is introduced into the tub 20 together with the water (washing water) through a connection pipe 16 so that detergent water (water+detergent) is supplied to a lower part of the tub 20 (specifically, between the tub and the drum) (504).

Accordingly, the controller 110 detects the level of water supplied to the tub 20 through the water level sensor 102 to determine whether the level of water is a set target water level (target water level frequency), and water supply operation is continued until the level of water supplied to the tub 20 reaches the set target water level.

When the level of the water supplied to the tub 20 reaches the target washing water level through the water supply operation, the controller 110 stops the water supply valve 15 to stop a washing water supply operation When the washing water (specifically, detergent water) is supplied to the target washing water level, the controller 110 drives the motor 7 with the motor RPM and the running speed set for the wash cycle to agitate and rotate the drum 30, and starts to carry out a wash cycle using the movement of laundry and water flow generated by the agitating and rotating operation of the drum 30 (506).

While the wash cycle proceeds, the controller 110 determines whether the laundry addition button 82 has been manipulated (508).

As a result of the determination in Operation 508, when it is determined that the laundry addition button 82 has been manipulated, the controller 110 carries out an operation algorithm to check the temperature inside the drum 30 and whether the drum 30 is being rotated to determine whether it is safe to open the auxiliary door 60 before unlocking the auxiliary door 60 (510). The algorithm for determining whether a condition is a safe operation condition in which the auxiliary door 60 may be opened is described in detail with reference to FIGS. 6A and 6B, FIGS. 7A and 7B and FIGS. 8A and 8B, and thus repetitive descriptions will be omitted.

Then, the controller 110 determines whether laundry is added by manipulating the laundry addition button 82 after a second time (for determining whether to compensate a washing time; about 10 minutes) has elapsed since the start of the wash cycle (512).

As a result of the determination in Operation 512, when it is determined that the second time has not elapsed, the controller 110 carries out the wash cycle according to the set washing time (514). This is because it is determined that, in the case where laundry is additionally loaded before the second time has elapsed since the start of the wash cycle, washing performance can be maintained even when the wash cycle is performed only for a predetermined washing time.

Meanwhile, as a result of the determination in Operation 512, when it is determined that the second time has elapsed, the controller 110 compensates the set washing time with the second time and progresses the wash cycle (516). Here, the compensation time does not exceed the second time so that the inconvenience the user may feel due to a prolonged washing time is eliminated. Further, in the case where laundry is additionally loaded at a time when the second time has elapsed since the start of the wash cycle, the wash cycle proceeds with a compensated wash time to maintain washing performance.

Further, the user may be informed of the extension of washing time by the compensation of the second time through the display 83 so that the user may select the compensation of the washing time.

Meanwhile, as a result of the determination in Operation 508, when it is determined that the laundry addition button 82 has not been manipulated, the controller 110 proceeds to Operation 514 to progress the wash cycle according to a set washing time and a subsequent operation is continued.

Then, the controller 110 determines whether the wash cycle has finished (518). When the wash cycle has finished, the controller 110 stops the motor 7 and operates the drain pump 5 to drain the detergent water (washing water+detergent). Thereafter, the wash cycle in which intermediate spin dry is performed is finished.

Meanwhile, the washing time is extended according to a time of adding the laundry in the wash cycle of the present disclosure, but the present disclosure is not limited thereto, and washing RPM may be adjusted to compensate washing performance according to addition of the laundry without extending the wash cycle time. Further, both the wash cycle time and the washing RPM may be adjusted to compensate washing performance according to addition of the laundry.

Figure 10:
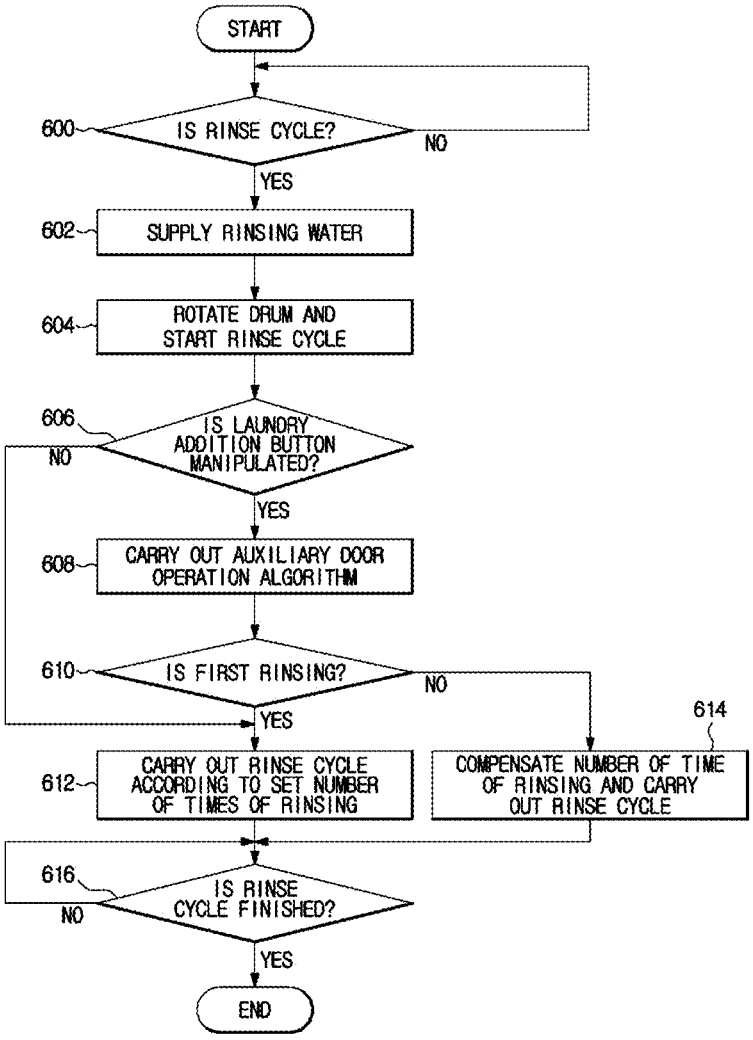
FIG. 10 is an operational flowchart of a control algorithm of a rinse cycle profile in the washing machine according to one embodiment of the present disclosure.

FIG. 10 is an operational flowchart of a control algorithm of a rinse cycle profile in the washing machine according to an embodiment of the present disclosure.

In FIG. 10, the controller 110 determines whether a cycle is a rinse cycle (600). When the cycle is a rinse cycle, the controller 110 operates the water supply valve 15 to supply water (rinsing water) required for the rinse cycle.

When the water supply valve 15 is operated, the water supply valve 15 is opened and water (rinsing water) is supplied to the tub 20 through the water supply pipe 14 (602). Here, the controller 110 may be configured to control the water supply operation by supplying water while agitating, that is, control the rinsing water to be supplied while agitating the drum 30 left and right to improve rinsing performance. As a result of the intermediate spin dry after the wash cycle, the laundry sticking to the drum 30 is dropped and mixed with the water, thereby improving the rinsing performance.

Accordingly, the controller 110 detects a level of water supplied to the tub 20 through the water level sensor 102 to determine whether the level of water is a set target rinsing water level (target water level frequency), and allows the water supplying operation to be continued until the level of water supplied to the tub 20 reaches the target rinsing level.

When supplying of the rinsing water until the target rinsing water level is completed, the controller 110 drives the motor 7 with the motor RPM and the operation rate set for the rinse cycle to rotate and agitate the drum 30 to generate the flow of water (rinsing water) contacting the laundry to start the progression of the rinse cycle (604).

While the rinse cycle proceeds, the controller 110 determines whether the laundry addition button 82 has been manipulated (606).

As a result of the determination in Operation 606, when it is determined that the laundry addition button 82 has been manipulated, the controller 110 carries out an operation algorithm to check the temperature inside the drum 30 and whether the drum 30 is being rotated to determine whether it is safe to open the auxiliary door 60 before unlocking the auxiliary door 60 (608).

Next, the controller 110 determines whether a time of adding laundry due to manipulation of the laundry addition button 82 is a first time of rinsing (610).

As a result of the determination in Operation 610, when it is determined to be a first time of rinsing, the controller 110 progresses the rinse cycle according to the set number of times of rinsing (612). This is because it is determined that, in the case where laundry is additionally loaded during the first time of rinsing, the rinsing performance can be maintained even when the rinse cycle proceeds only for the predetermined number of times of rinsing.

Meanwhile, as a result of the determination in Operation 610, when it is determined not to be the first time of rinsing, the controller 110 compensates the set number of times of rinsing with one more time of rinsing and the rinse cycle progresses (612). Here, the compensation number of times of rinsing does not exceed one time so that the inconvenience the user may feel due to a prolonged rinsing time is eliminated. Further, in the case where laundry is additionally loaded at a time when the number of times of rinsing is a second rinsing or a subsequent rinsing, the rinse cycle progresses with the compensated number of times of rinsing to maintain rinsing performance.

Subsequently, the controller 110 determines whether the rinse cycle has been completed (616). When the rinse cycle has been completed, the controller 110 stops the motor 7 and operates the drain pump 5 to drain water (rinsing water), and then the rinse cycle is finished.

Meanwhile, the number of times of rinsing is compensated by increasing the number of times of rinsing in the case where a time of adding the laundry is a second rinsing or a subsequent rinsing in the rinse cycle of the present disclosure, but the present disclosure is not limited thereto, and the rinse cycle may be further performed for a predetermined time from the time of the last rinsing so as to maintain the rinsing performance according to the addition of the laundry. Further, even when it is not limited to the last rinsing to further progress the rinse cycle for a predetermined time and the rinse cycle further proceeds for a certain period of time in any one of the subsequent rinsing operations, of course, the same objectives and effects as those of the present disclosure can be achieved.

Figure 11:
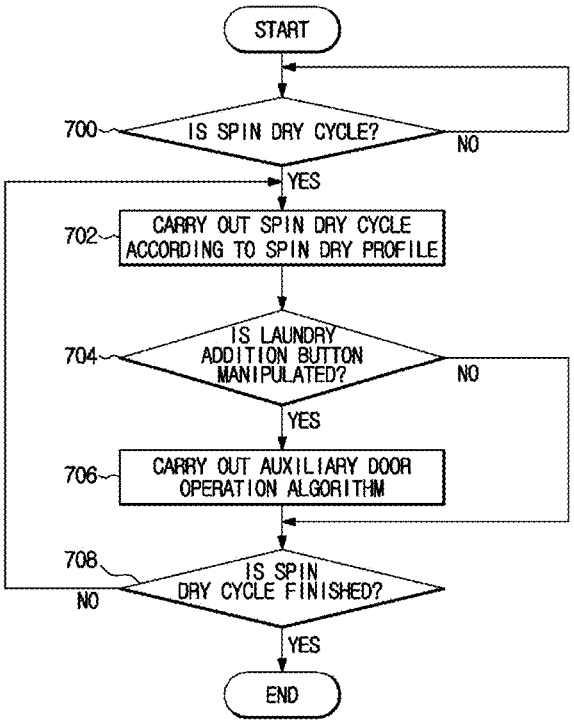
FIG. 11 is an operational flowchart of a first control algorithm of a spin dry cycle profile in the washing machine according to one embodiment of the present disclosure.

FIG. 11 is an operational flowchart of a first control algorithm of a spin dry cycle profile in the washing machine according to an embodiment of the present disclosure.

In FIG. 11, the controller 110 determines whether a cycle is a spin dry cycle (700). When the cycle is a spin dry cycle, the controller 110 accelerates the motor 7 at a set rotation speed (spin dry speed) according to a spin dry profile to progress the spin dry cycle (702).

While the spin dry cycle proceeds, the controller 110 determines whether the laundry addition button 82 has been manipulated (704).

As a result of the determination in Operation 704, when it is determined that the laundry addition button 82 has been manipulated, the controller 110 carries out an operation algorithm to confirm the temperature inside the drum 30 and whether the drum 30 is being rotated to determine whether it is safe to open the auxiliary door 60 before unlocking the auxiliary door 60 (706).

Subsequently, the controller 110 determines whether the spin dry cycle has been completed (708). When the spin dry cycle has been completed, the controller 110 stops the motor 7 and terminates the spin dry cycle.

Meanwhile, as a result of the determination in Operation 704, when it is determined that the laundry addition button 82 has not been manipulated, the controller 110 proceeds to Operation 708 to determine whether the spin dry cycle has finished and then proceeds to a subsequent operation.

Figure 12:
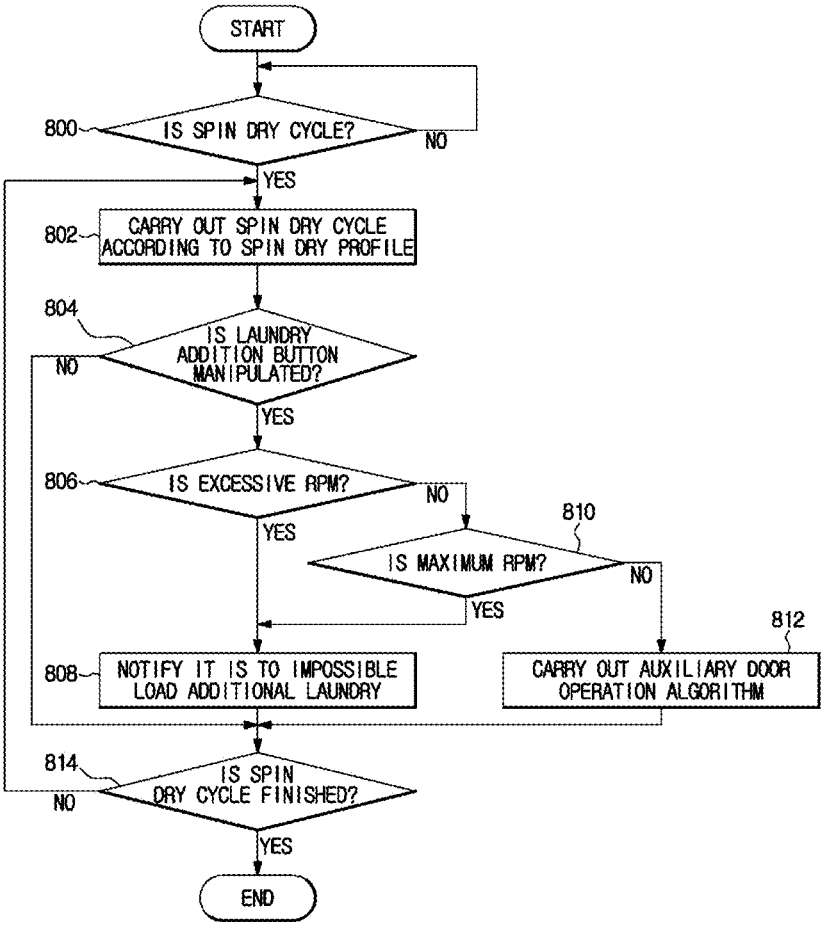
FIG. 12 is an operational flowchart of a second control algorithm of a spin dry cycle profile in the washing machine according to one embodiment of the present disclosure.

FIG. 12 is an operational flowchart of a second control algorithm of a spin dry cycle profile in the washing machine according to an embodiment of the present disclosure.

In FIG. 12, the controller 110 determines whether a cycle is a spin dry cycle (800). When the cycle is a spin dry cycle, the controller 110 accelerates the motor 7 at a predetermined rotation speed (spin dry speed) to perform the spin dry cycle (802).

During performing the spin dry cycle, the controller 110 determines whether the laundry addition button 82 has been manipulated (804).

As a result of the determination in Operation 804, when it is determined that the laundry addition button 82 has been manipulated, the controller 110 measures spin dry RPM to determine whether it is excessive RPM (about 300 RPM) (806).

As a result of the determination in Operation 806, when it is determined that it is excessive RPM, the controller 110 determines, as an operation condition, that the auxiliary door 60 may not be opened and outputs a sound (for example, a beep sound) through the sound outputter 140 so that the user is informed of a state in which laundry may not be added. Simultaneously, the display 83 flashes so that the user may easily check the state in which laundry may not be added (808).

Meanwhile, as a result of the determination in Operation 806, when it is determined not to be excessive RPM, the controller 110 determines whether the spin dry RPM is the maximum RPM (about 1000 to 1200 RPM) (810).

As a result of the determination in Operation 810, when it is determined to be maximum RPM, the controller 110 determines, as an operation condition, that the auxiliary door 60 may not be opened, and proceeds to Operation 808 to output a sound through the sound outputter 140 and allows the display 83 to flash to inform the user of the state in which laundry may not be added.

Meanwhile, as a result of the determination in Operation 810, when it is determined not to be maximum RPM, the controller 110 carries out an operation algorithm to confirm the temperature inside the drum 30 and whether the drum 30 is being rotated to determine whether it is safe to open the auxiliary door 60 before unlocking the auxiliary door 60 (812).

Subsequently, the controller 110 determines whether the spin dry cycle has been completed (814). When the spin dry cycle has been finished, the controller 110 stops the motor 7 and terminates the spin dry cycle.

Meanwhile, as a result of the determination in Operation 804, when it is determined that the laundry addition button 82 has not been manipulated, the controller 110 proceeds to Operation 814 to determine whether the spin dry cycle has been completed and proceeds to the subsequent operation.

In FIGS. 9 to 12, when laundry is to be additionally introduced through the auxiliary door 60, the cycle profile is changed to compensate the washing, rinsing and spin dry cycle performance. However, the embodiment of the present disclosure is not limited thereto, and the cycle profile for compensating the washing, rinsing and spin dry cycle performance may be changed even when laundry is to be added through the main door 70.

Further, laundry is additionally introduced through the auxiliary door 60 or the main door 70 in one embodiment of the present disclosure. However, in the embodiment of the present disclosure, the object to be added through the auxiliary door 60 or the main door 70 is not limited to laundry, and even when a detergent or a fabric softener is added, of course, the same objectives and effects as those of the present disclosure can be achieved.

The above detailed description is illustrative of the present disclosure. In addition, the above-described content is for explaining exemplary embodiments of the present disclosure, and the present disclosure may be used in other various combinations, changes, and environments. That is, the present disclosure may be changed or modified within the scope of the concept of the disclosure disclosed in the present specification, an equivalent scope to the described disclosure, and/or the scope of technology or knowledge in the art. The embodiments are illustrative of a best mode for implementing the technical spirit of the present disclosure, and various modifications required in a specific application field and purpose of the present disclosure are possible. Thus, the above detailed description of the disclosure is not to be construed as limited to the specific embodiments disclosed. Also, the attached claims should be interpreted to include other embodiments.

The invention claimed is:

1. A washing machine comprising:

a main body configured to form an exterior of the washing machine and includes a laundry port therein;

a tub installed inside the main body and configured to accommodate water;

a drum rotatably installed inside the tub and configured to accommodate laundry;

a detector configured to detect a temperature inside the tub;

a main door installed in the main body to open and close the laundry port;

an auxiliary door installed in the main door and configured to be openable and closable separately from the main door;

an inputter through which an operational signal for opening and closing of the auxiliary door is input; and a controller configured to control a locking of the auxiliary door based on the temperature detected by the detector in response to the operational signal.

2. The washing machine of claim 1, wherein:

the detector is further configured to detect a temperature inside the drum when the operational signal is input during operation of the washing machine, and the controller is further configured to unlock the auxiliary door when the detected temperature inside the drum is lower than a set temperature.

3. The washing machine of claim 1, wherein:

the detector is further configured to detect whether the drum is being rotated, and the controller is further configured to control the locking of the auxiliary door based on whether the drum is being rotated.

4. The washing machine of claim 3, wherein the controller is further configured to inform a user of an openable or closable state of the auxiliary door according to the detected temperature inside the drum and whether the drum is being rotated.

5. The washing machine of claim 1, wherein:

the detector is further configured to detect a level of water stored in the tub, and the controller is further configured to control the locking of the auxiliary door based on the detected level of water.

6. The washing machine of claim 1, wherein:

the auxiliary door is further configured to maintain a locked state during operation of the washing machine, and the drum is further configured to stop rotating when the locking state of the auxiliary door is released.

7. The washing machine of claim 1, wherein the controller is further configured to control a locking of the main door based on the temperature detected by the detector in response to the operational signal.

8. The washing machine of claim 7, wherein the controller is further configured to:

compare the detected temperature with a set temperature, and unlock the main door according to a comparison result.

9. The washing machine of claim 7, wherein:

the detector is further configured to detect whether the drum is being rotated, and the controller is further configured to control the locking of the main door based on whether the drum is being rotated.

10. The washing machine of claim 9, wherein the controller is further configured to inform a user of an openable or closable state of the main door according to the detected temperature inside the drum and whether the drum is being rotated.

11. A method of controlling a washing machine including a main body having a laundry port therein, a tub installed inside the main body and configured to accommodate water, a drum rotatably installed inside the tub, a main door installed in the main body to open and close the laundry port, and an auxiliary door installed in the main door and configured to be openable and closable separately from the main door, the method comprising:

determining whether an operational signal is input for opening of the auxiliary door while a cycle of the washing machine proceeds; and controlling a profile for each cycle of the washing machine when the operational signal is input.

12. The method of claim 11, wherein the cycle of the washing machine includes a wash cycle, a rinse cycle and a spin dry cycle.

13. The method of claim 12, further comprising:

counting down a washing time at an input time of the operating signal when the operating signal is input during the wash cycle; and extending a time of performing the wash cycle when the counted down washing time is compared with a set time and the washing time exceeds the set time.

14. The method of claim 12, further comprising:

determining a number of times of rinsing carried out at an input time of the operating signal when the operational signal is input during the rinse cycle; and controlling the number of times of rinsing of the rinse cycle when the number of times of rinsing carried out is not one.

15. The method of claim 12, further comprising:

informing a user of an unopenable state of the auxiliary door according to a spin dry RPM at an input time of the operating signal when the operational signal is input during the spin dry cycle.

* * * * *